US005918578A

United States Patent [19]

Oda

[11] Patent Number: 5,918,578

[45] Date of Patent: Jul. 6, 1999

[54] FUEL FEEDING SYSTEM FOR INTERNAL COMBUSTION ENGINE

[75] Inventor: Hideyuki Oda, Tokyo, Japan

[73] Assignee: Mitsubishi Jidosha Kogyo Kabushiki Kaisha, Tokyo, Japan

[21] Appl. No.: 08/945,519

[22] PCT Filed: Feb. 26, 1997

[86] PCT No.: PCT/JP97/00550

§ 371 Date: Jan. 20, 1998

§ 102(e) Date: Jan. 20, 1998

[87] PCT Pub. No.: WO97/32122

PCT Pub. Date: Sep. 4, 1997

[30] Foreign Application Priority Data

Feb. 29, 1996 [JP] Japan ..... 8-043881

[51] Int. Cl.[6] ..... F02M 37/04

[52] U.S. Cl. ..... 123/456; 123/514; 123/479

[58] Field of Search ..... 123/456, 198 D, 123/479, 359, 514, 446

[56] References Cited

U.S. PATENT DOCUMENTS

| | | | |
|---|---|---|---|
| 3,834,361 | 9/1974 | Keely | 123/479 |
| 4,520,780 | 6/1985 | Ito | 123/359 |
| 5,224,453 | 7/1993 | Bederna | 123/479 |
| 5,327,872 | 7/1994 | Morikawa | 123/514 |
| 5,493,902 | 2/1996 | Glidewell | 123/479 |
| 5,598,817 | 2/1997 | Igarashi | 123/456 |
| 5,626,121 | 5/1997 | Kushida | 123/456 |
| 5,715,786 | 2/1998 | Seiberth | 123/198 D |
| 5,731,515 | 3/1998 | Tominaga | 123/446 |

FOREIGN PATENT DOCUMENTS

| | | |
|---|---|---|
| A-58-35233 | 3/1983 | Japan . |
| 61-55160 U | 4/1986 | Japan . |
| A-7-77119 | 3/1995 | Japan . |
| A-7-77120 | 3/1995 | Japan . |
| A-7-83134 | 3/1995 | Japan . |
| A-7-83137 | 3/1995 | Japan . |

*Primary Examiner*—Carl S. Miller

[57] ABSTRACT

This invention relates to a fuel feeding system for an internal combustion engine, which is suited for use in an in-cylinder injection internal combustion engine. In a system provided with a control valve so that a fuel pressure can be changed over for an adjustment, it is an object of the present invention to permit good combustion in the engine even when the control valve becomes inoperative. The system is composed of a fuel line (3) arranged between a fuel injection valve (1) and a fuel tank (2), a low-pressure fuel pump (4), a high-pressure fuel pump (5), a high pressure control unit (10) for controlling a pressure of fuel from the high-pressure fuel pump (5), a fuel pressure control valve (14) for opening or closing a bypass passage (13), which bypasses the high pressure control unit (10), in accordance with a state of operation of the internal combustion engine, a low pressure control unit (9) for controlling to a lower pressure than the high pressure control unit (10), a fault detection unit (31) for detecting a fault in the fuel pressure control valve (14) and a resulting restriction of an opening of the bypass passage (13), and a drive duration changing unit (32) for changing, upon detection of a fault, a drive duration of the fuel injection valve (1) in accordance with a predetermined fuel pressure higher than a pressure controlled by the low-pressure control unit (9).

17 Claims, 6 Drawing Sheets

FUEL FEEDING SYSTEM FOR INTERNAL COMBUSTION ENGINE

TECHNICAL FIELD

This invention relates to a fuel feeding system for an internal combustion engine, which can perform an injection of fuel at a relatively high fuel pressure and is suited for use in an in-cylinder injection internal combustion engine.

BACKGROUND ART

As internal combustion engines of the system whereby fuel is injected inside a cylinder—such engines generally called, for example, in-cylinder injection internal combustion engines or direct-injection internal combustion engines (DI internal combustion engines)—diesel engines are widely known. In spark ignition engines (hereinafter called "gasoline engines", as they are gasoline engines in general), those of the in-cylinder injection type have been proposed in recent years.

In such in-cylinder injection internal combustion engines, with a view to improving performance of the engines and reducing exhaust gas, there is a tendency toward increasing a fuel injection pressure to make fuel mist finer and hence to shorten a fuel injecting duration. Further, for engines equipped with supercharging systems, a high fuel injection pressure corresponding to a supercharging pressure is required during supercharging.

A fuel feeding system in an in-cylinder injection internal combustion engine is therefore constructed to feed fuel to a fuel injection valve by further pressurizing fuel through a high-pressure fuel pump subsequent to its pressurization through a low-pressure fuel pump so that such a sufficiently-high fuel injection pressure (for example, of several tens of atmospheres) can be obtained.

As a high-pressure fuel pump, however, a fuel pump of the engine-driven type is generally adopted. Its delivery pressure therefore corresponds to an engine speed (the number of revolutions of an engine). At the time of start-up of an engine, the number of revolutions of the engine is hence small so that the high-pressure fuel pump has an extremely low delivery pressure. The high-pressure fuel pump between a low-pressure fuel pump and a fuel injection valve conversely interferes with a flow of fuel, and a fuel pressure at the fuel injection valve fails to reach even a delivery pressure level of the low-pressure fuel pump.

Further, after the initiation of a start-up operation of the engine, the number of revolutions of the engine is generally low and the delivery pressure of the high-pressure fuel pump is low. The fuel is therefore at a low pressure level. A controller accordingly actuates the fuel injection valve in a low pressure mode. Upon elapse of a predetermined time after the initiation of a start-up operation of the engine, the number of revolutions of the engine generally increases, the delivery pressure of the high-pressure fuel pump becomes higher, and the fuel is brought to a high pressure level. The controller therefore actuates the fuel injection valve in a high pressure mode.

However, depending on the state or environment of the engine, for example, upon attempting a start-up at an extremely low temperature, the number of revolutions of the engine may not increase even when the predetermined time has elapsed. In contrast, the number of revolutions of the engine may increase even before the predetermined time elapses. A disharmony therefore arises between a fuel pressure and a control mode (low pressure mode or high pressure mode) of the fuel injection valve by the controller. As a result, an adequate fuel injection cannot be performed, thereby making it difficult to maintain stable combustion.

With a view to making it possible to obtain a predetermined fuel pressure even when the delivery pressure of a high-pressure fuel pump is not sufficient as in a start-up of an internal combustion engine and, further, to enable good combustion performance in the engine in accordance with a fuel pressure, a fuel feeding system for an internal combustion engine such as that shown in FIG. 5 has therefore been proposed, for example, in Japanese Patent Application Laid-Open (Kokai) No. HEI 7-83134 or the like.

In FIG. 5, there are shown fuel injection valves (injectors) 1, a fuel tank 2, a fuel line 3 arranged between the fuel injection valves 1 and the fuel tank 2, a low-pressure fuel pump 4 arranged in the fuel line 3 at an upstream location on a side of the fuel tank 2, and a high-pressure fuel pump 5 arranged between the low-pressure fuel pump and the fuel injection valves 1. Also illustrated are fuel filters 6,7 arranged in inlet parts of the fuel line, a check valve 8, a low-pressure control valve 9 as a low-pressure control unit, and a high-pressure control valve as a high-pressure control unit.

This fuel feeding system for an internal combustion engine is applied to an in-cylinder injection gasoline engine in which fuel is directly injected into cylinders. As is illustrated in FIG. 5, the fuel line 3 is composed of a feed line 3A for feeding fuel from the fuel tank 2 to the injectors 1 and a return line 3B for returning fuel, which has not been injected through the injectors 1, to the fuel tank 2. Further, the injectors 1 are fed with fuel through a delivery pipe 1A. This delivery pipe 1A itself shall also be considered herein as a part of the fuel line 3.

The low-pressure fuel pump 4 is an electrically-driven feed pump arranged in the feed line 3A of the fuel line 3 at an upstream location thereof within the fuel tank 2, and is actuated concurrently with a start-up of the engine and is stopped at the time of a stop of the engine. It can produce a predetermined delivery pressure irrespective of an engine speed, and pressurizes fuel from a level of atmospheric pressure to about several atmospheres or so.

The high-pressure fuel pump 5 serves to pressurize the fuel, which has been delivered from the low-pressure fuel pump 4, to several tens of atmospheres or so. As this high-pressure fuel pump 5, a pump of the engine-driven type (hereinafter called the "engine-driven pump") is used. Obviously, the high-pressure fuel pump operates in direct association with an operation of the engine and produces a delivery pressure in accordance with an engine speed.

Incidentally, the check valve 8 is interposed in the feed line 3A between the low-pressure-fuel pump 4 and the high-pressure fuel pump 5. By this check valve 8, the pressure of fuel delivered from the low-pressure fuel pump 4 is maintained.

Further, between the feed line 3A and the return line 3B of the fuel line 3, the low-pressure control valve (low-pressure regulator) 9 is arranged to regulate a delivery pressure from the low-pressure fuel pump 4 to a preset pressure (for example, 0.33 MPa, namely, about 3 atm or so).

At a location immediately downstream of the injectors 1, a high-pressure control valve (high-pressure regulator) 10 is disposed to regulate a delivery pressure from the high-pressure fuel pump 5 to a preset pressure (for example, 5 MPa, namely, 50 atmospheres or so).

A bypass passage (hereinafter called the "first bypass passage") 11 is arranged bypassing the high-pressure fuel pump 5. In this first bypass passage 11, a check valve 12 is disposed to permit passage of fuel only from an upstream side to a downstream side of the feed line 3A. This check valve 12 opens the first bypass passage 11 when the high-pressure fuel pump 5 does not operate fully, and closes the first bypass passage 11 when the high-pressure fuel pump 5 operates fully.

In addition, a bypass passage (hereinafter called the "second bypass passage") 13 is arranged bypassing the high-pressure control valve 10. This bypass passage 13 is provided with a solenoid-operated directional control valve (fuel pressure control valve) 14. This solenoid-operated directional control valve 14 opens at the time of a start-up of the engine, and remains closed after the start-up.

At a location immediately downstream of the solenoid-operated directional control valve 14, an orifice 15 is arranged so that, even when the return line 3B is still open shortly after a start-up of the engine, a fuel pressure close to a preset pressure controlled by the low-pressure control valve 8 can be obtained. This second bypass passage 13 enables a discharge of vapor (vapor bubbles), which are contained in the fuel line 3 around the injectors 1, in an initial stage of a start-up of the engine.

A controller 30 then controls the solenoid-operated directional control valve 14 so that the solenoid-operated directional control valve 14 is energized and opened at the time of a start-up operation and is deenergized and closed in a normal operation state.

At the time of a start-up operation, an injector gain and an injector dead time are also set on low pressure sides.

Owing to the constitution as described above, control of a fuel supply can be performed, for example, as shown in FIG. 6.

First, it is determined whether or not the engine is in a stalled state (step S401). If it is not in a stalled state, it is then determined whether or not an ignition key switch 16 has been turned to a starter-on position (step S402). If the ignition key switch 16 has been turned to the starter-on position, a start-up operation mode is set and a timer is reset to 0 (step S403).

In this case, concurrently with a start-up (namely, cranking) of the engine, the low-pressure fuel pump 4 and the high-pressure fuel pump 5 are actuated and at the same time, the controller 30 energizes the solenoid-operated directional control valve 14 to open the second bypass passage 13 (step 404) and also drives the fuel injection valves 1 under control in a particular operation mode. Namely, an injector gain for a low pressure mode is selected (step S405) and an injector dead time for the low pressure mode is selected (step S406).

Then, if an engine speed is determined to be in excess of a predetermined value (for example, 430 rpm), the start-up mode is determined to have ended. The routine thus advances from step S402 to step S407, where it is determined whether or not an engine speed has exceeded a first reference speed (for example, 1,000 rpm). If the engine speed is determined to be in excess of the first reference speed (1,000 rpm), the timer starts counting (step S408).

A determination in step S409 is then performed, that is, it is determined whether or not a count of the timer has reached a predetermined value. If the count of the timer has not reached the predetermined value, the routine advances to step S410 to determine whether or not the engine speed has exceeded a second reference speed (for example, 2,000 rpm).

If the engine speed has not exceeded the second reference speed (2,000 rpm), the operations of steps S404–S406 are continued until a count of the timer reaches the predetermined value (namely, until a predetermined time has elapsed).

In this state, the fuel—which has been delivered from the low-pressure fuel pump (feel pump) 4 and then regulated to a predetermined low pressure value through the downstream low-pressure control valve (low-pressure regulator) 9—is supplied to the fuel injection valves (injectors) 1 and any surplus portion of the fuel is returned to the fuel tank. The low-pressure fuel pump 4 is promptly brought to a delivery pressure level of a predetermined pressure (several atmospheres) subsequent to a start-up. Shortly after the start-up of the engine, however, the engine speed does not increase so that the high-pressure fuel pump 5 cannot produce a sufficient delivery pressure.

Shortly after the start-up of the engine, the high-pressure fuel pump 5 therefore rather acts as a resistance to the passage of a flow of the fuel through the fuel line 3 under the delivery pressure from the low-pressure fuel pump 4. In this system, however, the fuel is supplied toward the fuel injection valves 1 through the first bypass passage 11 arranged in parallel with the high-pressure fuel pump 5. From the fuel injection valves 1, a fuel injection can therefore be performed at a fuel pressure similar to a pressure regulated by the low-pressure control valve 9.

Shortly after a start-up of an engine, a quantity of fuel required for combustion is generally small so that a pulse width for fuel injection is short. Further, a pulse timing for the fuel injection is sufficient if it takes place only in an intake stroke as in the conventional multipoint injection (MPI). As the injector gain and injector dead time for the low pressure mode are selected accordingly and the fuel injection is then performed, the engine speed can be smoothly increased even at a fuel pressure similar to the level of the pressure regulated by the low-pressure control valve 9 insofar as the fuel pressure is stable.

As a consequence, with an increase in the engine speed, the delivery rate of the high-pressure fuel pump 5 progressively increases and the delivery pressure of the high-pressure fuel pump 5 also increases smoothly. When the engine speed has exceeded the second reference speed (2,000 rpm), or when a predetermined time has elapsed with an engine speed in excess of the first reference speed (1,000 rpm) but not higher than the second reference speed (2,000 rpm), the routine advances from step S409 or step S410 to step S411 and the controller 30 closes the solenoid-operated directional control valve 14 to drive the fuel injection valves 1 under control in a normal operation mode (namely, the high pressure mode). Namely, an injector gain for the high pressure mode is selected (step S412), and an injector dead time for the high pressure mode is selected (step S413). Then, the timer is reset to 0 (step S414). After that, the operations of steps S411–S414 are continued for as long as the engine does not stop.

As a result, the fuel is delivered from the low-pressure fuel pump (feed pump) 4 and is then pressurized to a high pressure through the high-pressure fuel pump 12. Further, the fuel which has been regulated to a predetermined high pressure value by the high-pressure control valve (high-pressure regulator) 10 is supplied to the fuel injection valves (injectors) 1 and any surplus portion of the fuel is returned to the fuel tank.

Accordingly, the delivery pressure of the high-pressure fuel pump 5 progressively increases the fuel pressure on the downstream side of the high-pressure fuel pump 5 without being lost, whereby the fuel pressure is raised to or beyond the pressure regulated by the high-pressure control valve 10. Further, owing to the selection of the injector gain for the high pressure mode and the injector dead time for the high pressure mode, fuel injection can be performed adequately.

The delivery pressure of the high-pressure fuel pump 5 rises to a sufficient level as described above, thereby making it possible to perform fuel injection from the fuel injection valves 1 at a high fuel pressure similar to the pressure regulated by the high-pressure control valve 10. The engine speed is therefore smoothly increased from shortly after a start-up of the engine. It is therefore possible to obtain a high fuel injection pressure, which is required for shortening the fuel injection duration (namely, the pulse width for fuel injection) or is required corresponding to a supercharging pressure during supercharging, for example, in an in-cylinder injection internal combustion engine.

Further, the solenoid-operated directional control valve 14 which serves to open or close the second bypass passage 13 is closed after the predetermined time (a relatively short time) has elapsed and a discharge of vapor has been fully effected. Then, it is therefore possible to raise the fuel pressure to a pressure regulated by the high-pressure control valve 10, thereby making it possible to obtain a sufficient fuel injection pressure, for example, during a high speed operation or the like.

Incidentally, according to the above-described conventional art (see FIG. 5 and FIG. 6), a specific operation state is set, the solenoid-operated directional control valve 14 is opened, and upon start-up, a flow passage is secured on the downstream side of the injectors 1 for the fuel delivered from the low-pressure fuel pump 4. The fuel is therefore allowed to stably flow at a low pressure. With this fuel flow, vapor (vapor bubbles) which are contained in the fuel line 3 around the injectors 1 are discharged in an initial stage of a start-up of the engine.

Nonetheless, a situation is conceivable where the solenoid-operated directional control valve 14 may become not fully operative or inoperative due to a disconnection, sticking of the solenoid-operated directional control valve 14 or the like. As the solenoid-operated directional control valve 14 is set in a closed position under the force of a spring while no electricity is supplied, the second bypass passage 13 remains closed in such a situation, that is, upon occurrence of a disconnection or sticking of the solenoid-operated directional control valve 14, so that the fuel pressure cannot be controlled to a low pressure. However, when a drive signal is delivered to the solenoid-operated directional control valve 14, a signal is concurrently sent to the injectors to control their drive duration to a fuel injection valve drive duration corresponding to a low fuel pressure (i.e., a duration longer than that for a high pressure time). Although the fuel pressure has arisen actually, the injectors are therefore actuated corresponding to a pressure lower than the fuel pressure. The fuel is hence not injected in an appropriate quantity, leading to a problem that the engine is deteriorated in start-up performance and in worst cases, may become no longer feasible to perform a start-up.

With the foregoing problem in view, the present invention has been completed. An object of the present invention is therefore to provide a fuel feeding system for an internal combustion engine, which makes it possible to perform good combustion in the engine even when a fuel pressure determination unit such as a fuel pressure control valve becomes inoperative.

DISCLOSURE OF THE INVENTION

A fuel feeding system according to the present invention for an internal combustion engine therefore comprises: a low-pressure fuel pump arranged between a fuel injection valve disposed in the internal combustion engine and a fuel tank; a fuel line constituted as a recirculating circuit which extends from the fuel tank to the fuel injection valve and further returns from the fuel injection valve to the fuel tank; a high-pressure fuel pump arranged in the fuel line between the low-pressure fuel pump and the fuel injection valve and driven by the internal combustion engine; a high-pressure control unit arranged in the fuel line on a downstream side of the high-pressure fuel pump for controlling a pressure of fuel delivered from the high-pressure fuel pump; a fuel pressure control valve arranged in a bypass passage, which extends from an upstream side to a downstream side of the high-pressure control unit, for opening or closing the bypass passage in accordance with a state of operation of the internal combustion engine; a low-pressure control unit for controlling, upon opening the bypass passage by the fuel pressure control valve, a fuel pressure in the fuel line on an upstream side of the bypass passage to a pressure lower than a pressure controlled by the high-pressure control unit; a fault detection unit for detecting a fault in the fuel pressure control valve and a resulting restriction of an opening of the bypass passage; and a drive duration changing unit for changing, upon detection of a fault by the fault detection unit, a drive duration of the fuel injection valve in accordance with a predetermined fuel pressure higher than a pressure controlled by the low-pressure control unit.

Owing to this constitution, there is an advantage that, even when the fuel pressure control valve develops a fault due to a disconnection or the like, the drive duration of the fuel injection valve can be set corresponding to a fuel pressure higher than a controlled pressure by the low-pressure control unit and the combustion in the engine can be performed adequately.

Preferably, the fuel feeding system may further comprises a revolution speed sensor for detecting a revolution speed of the high-pressure fuel pump or of a rotary member rotating in synchronization with the high-pressure fuel pump, whereby the predetermined fuel pressure is estimated from the revolution speed detected by the revolution speed sensor.

For this constitution, there is an advantage that, even when the fuel pressure control valve develops a fault due to a disconnection or the like, the operation state of the internal combustion engine, in other words, the drive duration of the fuel injection valve can be appropriately set corresponding to a fuel pressure and the combustion in the engine can be performed adequately.

The drive duration changing unit may preferably be provided with a fuel pressure estimation unit for estimating a fuel pressure on a basis of a revolution speed detected by the revolution speed sensor so that a drive duration of the fuel injection valve may be changed in accordance with the fuel pressure estimated by the fuel pressure estimation unit.

Similarly to the advantage mentioned above, this constitution has brought about an advantage that, even when the fuel pressure control valve develops a fault due to a disconnection or the like, the operation state of the internal combustion engine, in other words, the drive duration of the fuel injection valve can be suitably set corresponding to a fuel pressure and the combustion in the engine can be performed adequately.

Preferably, the drive duration changing unit may change a drive duration of the fuel injection valve on a basis of a revolution speed detected by the revolution speed sensor upon detection of a fault by the fault detection unit while using a revolution speedfuel injection valve drive duration map set beforehand on a basis of a relationship between revolution speed and fuel pressure.

Because of this constitution, the drive duration of the fuel injection valve can be set directly from the revolution speed, leading to an advantage that a control logic can be simplified.

Further, the fuel pressure control valve may preferably be opened for a predetermined period at a time of a start-up of the internal combustion engine.

Owing to this constitution, even when the fuel pressure control valve develops a fault in the predetermined period at the time of a start-up of the internal combustion engine, the operation state of the internal combustion engine, namely, the drive duration of the fuel injection valve can be suitably set corresponding to a fuel pressure, thereby making it possible to avoid such a situation that the internal combustion is deteriorated in startability and, in worst cases, become no longer feasible to perform a start-up. This leads to an advantage that startability of at least a minimum level can be assured.

A drive duration of the fuel injection valve may preferably be changed by the drive duration changing unit for at least the predetermined period.

Owing to this constitution, even when the fuel pressure control valve develops a fault in the predetermined period at the time of a start-up of the internal combustion engine, the operation state of the internal combustion engine, namely, the drive duration of the fuel injection valve can be suitably set corresponding to a fuel pressure, thereby making it possible to avoid such a situation that the internal combustion is deteriorated in startability and, in worst cases, become no longer feasible to perform a start-up. Startability of at least a minimum level is therefore assured. Moreover, upon elapse of the predetermined period, the drive duration of the fuel injection valve can be properly set corresponding to a high fuel pressure. They lead to an advantage that the combustion in the engine can be performed adequately.

Another fuel feeding system according to the present invention for an internal combustion engine comprises: a low-pressure fuel pump arranged between a fuel injection valve disposed in the internal combustion engine and a fuel tank; a fuel line constituted as a recirculating circuit which extends from the fuel tank to the fuel injection valve and further returns from the fuel injection valve to the fuel tank; a high-pressure fuel pump arranged in the fuel line between the low-pressure fuel pump and the fuel injection valve and driven by the internal combustion engine; a high-pressure control unit arranged in the fuel line on a downstream side of the high-pressure fuel pump for controlling to a first controlled pressure a pressure of fuel delivered from the high-pressure fuel pump; a fuel pressure control valve arranged in a bypass passage, which extends from an upstream side to a downstream side of the high-pressure control unit, for opening or closing the bypass passage in accordance with a state of operation of the internal combustion engine; a low-pressure control unit for controlling, upon opening the bypass passage by the fuel pressure control valve, a fuel pressure in the fuel line on an upstream side of the bypass passage to a second controlled pressure lower than the first controlled pressure by the high-pressure control unit; a drive duration setting unit for setting a first drive duration as a drive duration of the fuel injection valve corresponding to the first controlled pressure and a second drive duration as a drive duration of the fuel injection valve corresponding to the second controlled pressure, said second drive duration being longer than the first drive duration; a fault detection unit for detecting a fault in the fuel pressure control valve and a resulting restriction of an opening of the bypass passage; and a drive duration changing unit for changing, upon detection of a fault by the fault detection unit, a drive duration of the fuel injection valve to a third drive duration which falls between the first drive duration and the second drive duration.

This constitution brings about an advantage that, while permitting simplification of a control logic, the drive duration of the fuel injection valve can be brought into substantial conformity with the fuel pressure and the combustion in the engine can be performed adequately.

Preferably, the drive duration changing unit may change a drive duration of the fuel injection valve to the third drive duration upon an elapse of a predetermined time after detection of a fault by the fault detection unit.

This constitution leads to an advantage that the control logic can be simplified further.

A further fuel feeding system according to the present invention for an internal combustion engine, comprises: a low-pressure fuel pump arranged between a fuel injection valve disposed in the internal combustion engine and a fuel tank; a fuel line constituted as a recirculating circuit which extends from the fuel tank to the fuel injection valve and further returns from the fuel injection valve to the fuel tank; a high-pressure fuel pump arranged in the fuel line between the low-pressure fuel pump and the fuel injection valve and driven by the internal combustion engine; a revolution speed sensor for detecting a revolution speed of the high-pressure fuel pump or of a rotary member rotating in synchronization with the high-pressure fuel pump; a fuel pressure determination unit for directly or indirectly determining a fuel pressure in the fuel line on a downstream side of the high-pressure fuel pump in accordance with a value substantially correlated to the fuel pressure in the fuel line on the downstream side of the high-pressure fuel pump; a drive duration setting unit for setting a drive duration of the fuel injection valve on a basis of results of a determination by the fuel pressure determination unit; a fault detection unit for detecting a fault in at least the fuel pressure determination unit; and a drive duration changing unit for changing, upon detection of a fault by the fault detection unit, a drive duration of the fuel injection valve on a basis of results of a detection by the revolution speed sensor.

Owing to this constitution, there is an advantage that, even when the fuel pressure determination unit develops a fault due to a disconnection or the like, the drive state of the high-pressure fuel pump, in other words, the drive duration of the fuel injection valve can be properly set corresponding to a fuel pressure and the combustion in the engine can be performed adequately.

Further, the fuel pressure determination unit may be provided with a fuel pressure control valve which can change over to plural levels a fuel pressure in the fuel line on the downstream side of the high-pressure fuel pump.

For this constitution, the fuel pressure is changed over by the fuel pressure control valve, and a suitable fuel pressure can be selected in accordance with an operation state. This leads to an advantage that the combustion in the engine can be performed adequately.

Preferably, the fuel pressure determination unit may be provided with a fuel pressure sensor for detecting a fuel pressure in the fuel line on the downstream side of the high-pressure fuel pump.

This constitution makes it possible to set the drive duration of the fuel injection valve in accordance with the fuel pressure without changing over the fuel pressure, leading to an advantage that the combustion in the engine can be performed adequately.

BEST MODE FOR CARRYING OUT THE INVENTION

With reference to the drawings, a description will hereinafter be made about the embodiments of the present invention.

Figure 1:
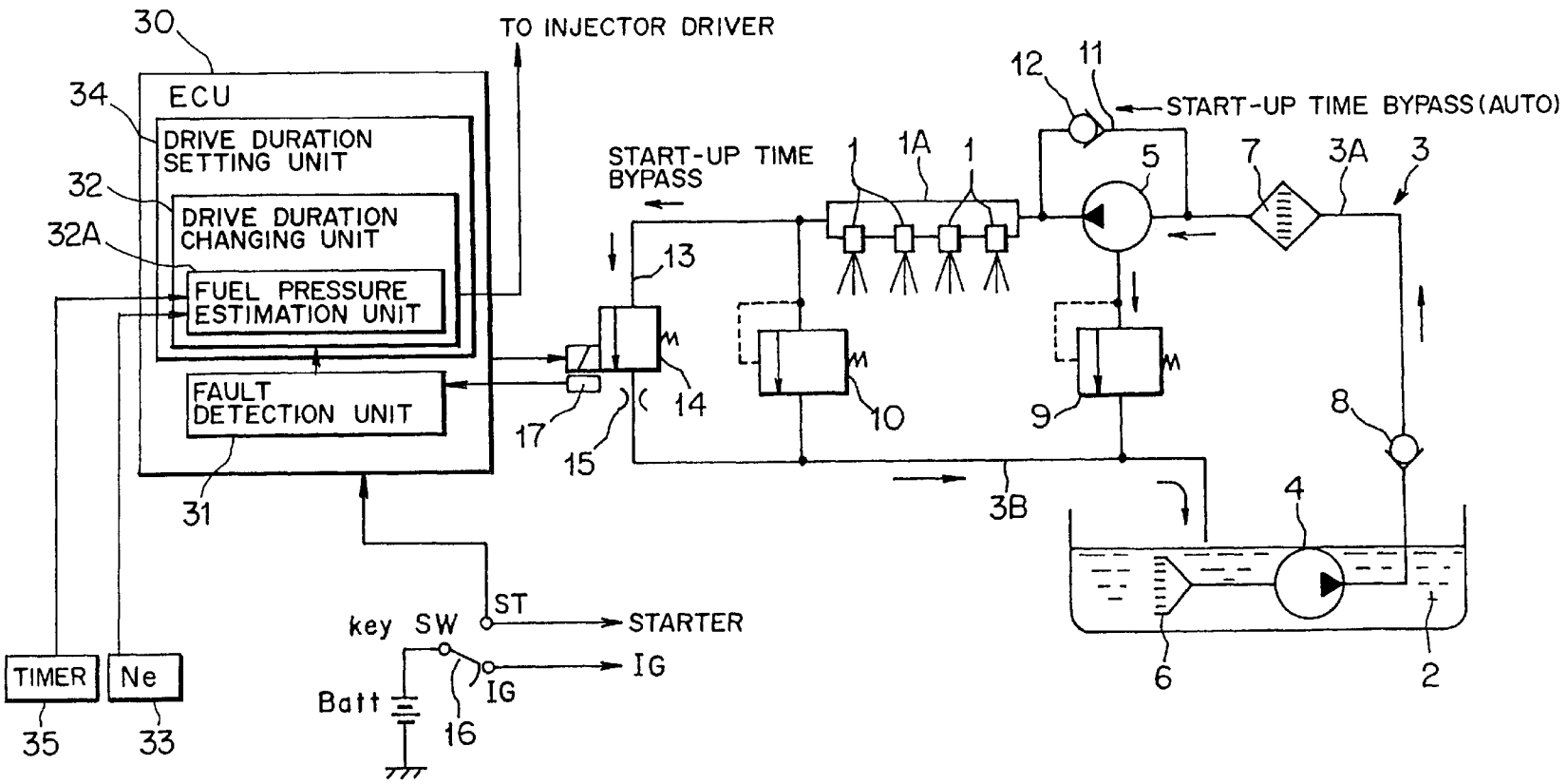
FIG. 1 is a schematic block diagram showing a fuel feeding system according to a first embodiment of the present invention for an internal combustion engine.
Figure 2:
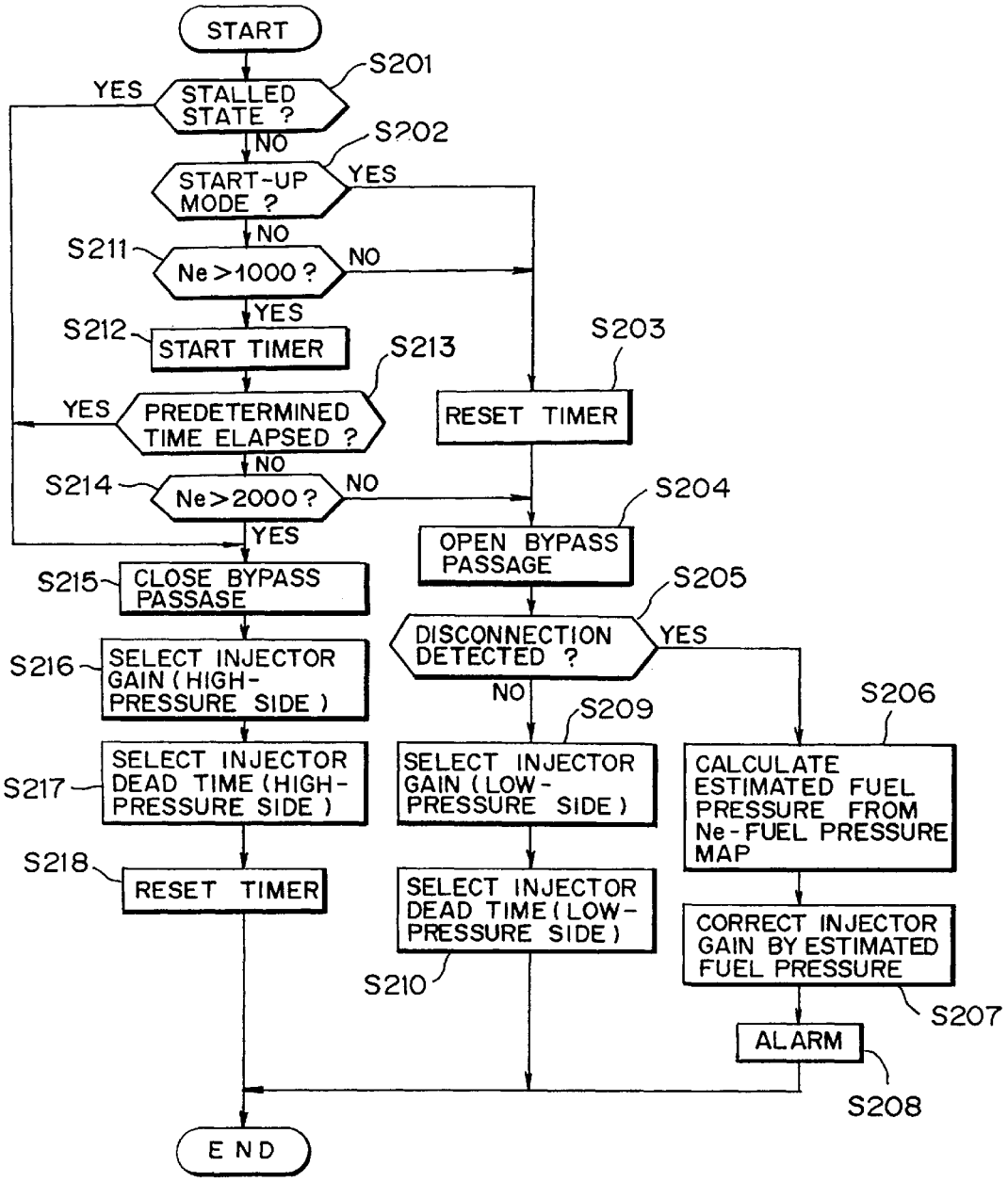
FIG. 2 is a flow chart illustrating operation of the fuel feeding system according to the first embodiment of the present invention for the internal combustion engine.
Figure 5:
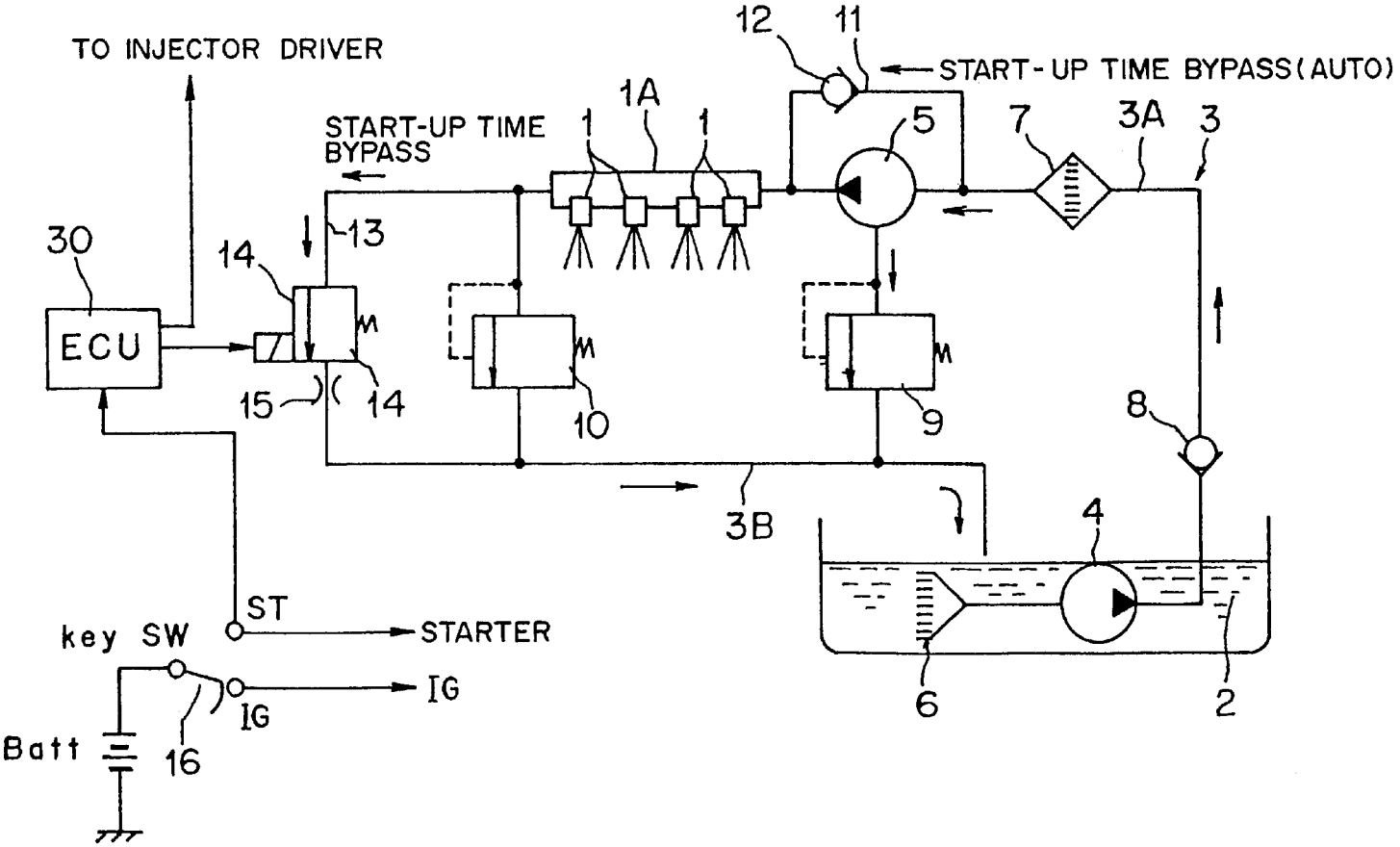
FIG. 5 is a schematic block diagram showing a conventional fuel feeding system for an internal combustion engine.
Figure 6:
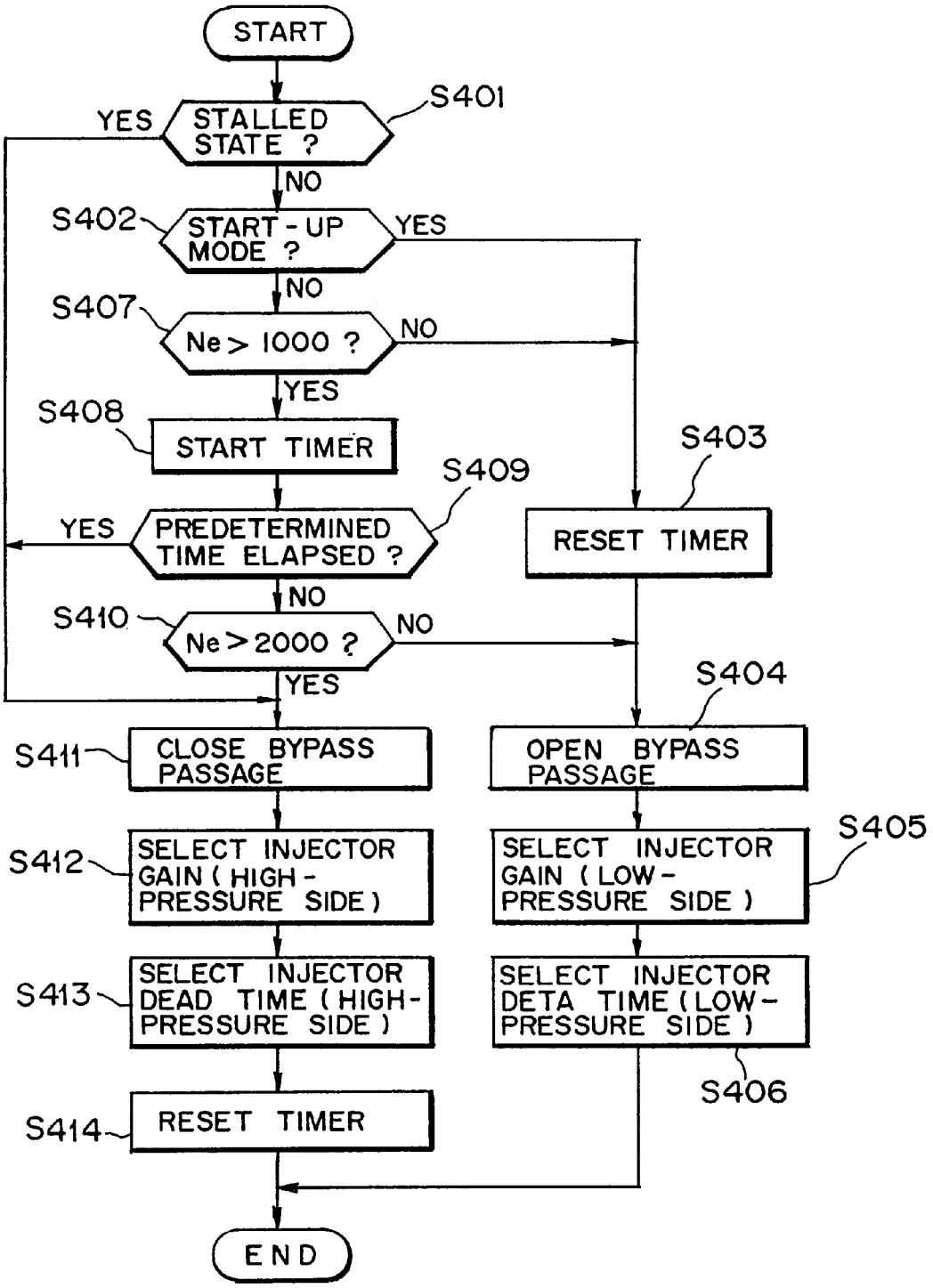
FIG. 6 is a flow chart illustrating operation of the conventional fuel feeding system for the internal combustion engine.

First, the fuel feeding system according to the first embodiment of the present invention for the internal combustion engine will be described. FIG. 1 is its schematic block diagram, and FIG. 2 is its flow chart illustrating its operation. The system according to the first embodiment of the present invention has substantially the same constitution as the above-described conventional art (see FIG. 5 and FIG. 6) except for the constitution of a control unit. Specifically, the system is applied to a 4-cycle gasoline engine as the internal combustion engine, especially to an in-cylinder injection gasoline engine in which fuel is directly injected into cylinders. As is illustrated in FIG. 1, a fuel line 3 which extends between fuel injection valves (injectors) 1 and a fuel tank 2 is provided with a low-pressure fuel pump (feed pump) 4 and a high-pressure fuel pump 5.

Incidentally, the fuel line 3 is composed of a feed line 3A for feeding fuel from the fuel tank 2 to the fuel injection valves 1 and a return line 3B for returning fuel, which has not been injected through the fuel injection valves 1, to the fuel tank 2. Further, the fuel injection valves 1 are fed with fuel through a delivery pipe 1A. This delivery pipe 1A itself shall also be considered herein as a part of the fuel line 3.

The fuel injection valves 1 are computer-controlled in its operation by a controller (ECU) 30 as the control unit. Described specifically, the controller 30 energizes the fuel injection valves 1 by a pulsed current in accordance with information such as an engine speed Ne and an inducted air quantity to perform fuel injection so that a desired fuel injection quantity can be obtained at a desired timing.

This timing of fuel injection is set based on a crank angle. As a matter of fact, there is however a response lag until an injection of fuel actually takes place subsequent to energization of each fuel injection valve 1 (this is called an "injector dead time"). The timing of fuel injection is therefore set in view of the injector dead time. On the other hand, the fuel injection quantity is set based on a pulse width of the above-described pulsed current. This pulse width is set as an injector gain corresponding to a target fuel injection quantity.

The low-pressure fuel pump 4 is a feed pump arranged in the feed line 3A of the fuel line 3 at an upstream location thereof within the fuel tank 2, and an electrically-driven pump is used. When actuated, it delivers the fuel in the fuel tank 2 toward a downstream side of the feed line 3A while filtering the fuel through a fuel filter 6. The pressurization of the fuel by the low-pressure fuel pump 4 at this time can range from the level of atmospheric pressure to several atmospheres or so. Further, the low-pressure fuel pump 4 is actuated concurrently with a start-up of the engine and is stopped at the time of a stop of the engine. Of course, it can produce a predetermined delivery pressure irrespective of an engine speed (a rotational speed of the engine).

The high-pressure fuel pump 5 serves to pressurize the fuel, which has been delivered from the low-pressure fuel pump 4, to several tens of atmospheres or so. As this high-pressure fuel pump 5, a pump of the engine-driven type (hereinafter called the "engine-driven pump") more advantageous as a high-pressure pump than an electrically-driven pump in pump efficiency and cost, for example, a reciprocating compression pump is used. Obviously, the high-pressure fuel pump is designed to operate in direct association with an operation of the engine and to produce a delivery pressure in accordance with an engine speed.

Incidentally, a check valve 8 and a fuel filter 7 are interposed in the feed line 3A between the low-pressure-fuel pump 4 and the high-pressure fuel pump 5. By the check valve 8, the pressure of fuel delivered from the low-pressure fuel pump 4 is maintained. Further, the fuel is filtered further by the fuel filter 7.

Further, between the feed line 3A and the return line 3B of the fuel line 3, that is, between a part of the feed line 3A, which is a part downstream of the fuel filter 7 and is on an upstream side of the high-pressure fuel pump 5, and a most downstream part of the return line 3B, a low-pressure control valve (low-pressure regulator) 9 is arranged as a low-pressure control unit for regulating a delivery pressure from the low-pressure fuel pump 4 to a preset pressure (for example, 3 atm). This low-pressure control valve 9 remains closed until the delivery pressure from the low-pressure fuel pump 4 exceeds the preset pressure (for example, 3 atm). When the delivery pressure exceeds the preset pressure, the fuel in a quantity equivalent to an excess pressure is returned directly to the side of the fuel tank 2, whereby the fuel pressure to be fed to the high-pressure fuel pump 5 is stabilized around the preset pressure. Needless to say, the low-pressure fuel pump 4 is set to give a delivery pressure equal to or higher than the preset pressure so that the preset pressure can be obtained.

At a location immediately downstream of the fuel injection valves 1, specifically in the most upstream part of the return line 3B of the fuel line 3, a high-pressure control valve (high-pressure regulator) 10 is disposed as a high-pressure control unit for regulating a delivery pressure from the high-pressure fuel pump 5 to a preset pressure (for example, 50 atmospheres). This high-pressure control valve 10 remains closed until the delivery pressure from the high-pressure fuel pump 5 exceeds the preset pressure (for example, 50 atmospheres). When the delivery pressure exceeds the preset pressure, the fuel in a quantity equivalent to an excess pressure is returned to the side of the fuel tank 2, whereby the fuel pressure at the fuel injection valves 1 is stabilized at a predetermined pressure.

To permit feeding of the fuel, which is flowing through the supply line 3A of the fuel line 3, to the fuel injection valves 1 by bypassing the high-pressure fuel pump 5, the fuel supply system of this embodiment is provided with a bypass passage (hereinafter called "the first bypass passage") which connects an upstream part and a downstream part of the high-pressure fuel pump 5 with each other. In this first bypass passage 11, a check valve 12 is disposed to permit passage of fuel only from an upstream side to a downstream side of the feed line 3A. This check valve 12 opens the first bypass passage 11 when the high-pressure fuel pump 5 does not operate fully and the fuel pressure is lower on the downstream side of the high-pressure fuel pump 5 than on its upstream side, and closes the first bypass passage 11 when the high-pressure fuel pump 5 operates fully and the fuel pressure becomes higher on the downstream side of the high-pressure fuel pump 5 than on its upstream side.

To permit a discharge of the fuel, which is located around the fuel injection valves 1, toward the fuel tank 2 by bypassing the high-pressure control valve 10, the fuel feeding system of this embodiment is also provided with a bypass passage (hereinafter called "the second bypass passage") 13 which connects an upstream part of the high-pressure control valve 10 and its downstream part with each other. This second bypass passage 13 is arranged to discharge vapor (vapor bubbles), which are contained in the fuel passage 3 in a vicinity of the fuel injection valves 1, in an initial stage of a start-up of the engine. Accordingly, the second bypass passage 13 is provided with a solenoid-operated directional control valve (fuel pressure control valve) 14 for opening or closing the second bypass passage 13 and also with a fuel pressure holding device 15 capable of holding the fuel pressure at a predetermined level on an upstream side of the second bypass passage 13, namely, in the area of the fuel injection valve 1.

The solenoid-operated directional control valve 14 is designed to open the second bypass passage 13 when energized and actuated and to close the second bypass passage 13 when deenergized and non-actuated. The solenoid-operated directional control valve 14 is ON/OFF-controlled by the controller 30. The solenoid-operated directional control valve 14 is designed to close the second bypass passage 13 under the force of the spring when not supplied with electricity. The solenoid-operated directional control valve 14 is also designed in such a way that, when supplied with electricity, force is applied in a direction opposite to the force of the spring and the second bypass passage 13 is opened. The solenoid-operated directional control valve 14 is also provided with a switch 17, which can be turned on or off responsive to opening or closing of the solenoid-operated directional control valve 14.

At this controller 30, control is performed to open the solenoid-operated directional control valve 14 in a specific operation state and to close the solenoid-operated directional control valve 14 in a normal operation state. In this embodiment, the specific operation state is defined based on an engine speed (a rotational speed of the engine) Ne and a time (a state of timer). This specific operation state can be divided into a start-up operation mode and the other operation mode. Incidentally, it is designed to obtain the engine speed Ne from an engine speed sensor 33 and the time from a timer 35.

In the start-up operation mode, the solenoid-operated direction control valve 14 is opened, the injector gain is set on the low pressure side, and the injector dead time is also set on the low pressure side. These settings are performed by a drive duration setting unit 34 which will be described subsequently herein.

The start-up operation mode can be determined, for example, based on an engine speed. Described specifically, the controller determines that the engine be considered to be in the start-up mode when the engine speed Ne is still lower than a predetermined value (for example, 430 rpm) after, responsive to a signal from an ignition key switch 16, the ignition key switch 16 is operated to a starter position and a start-up operation is initiated. When the engine speed Ne increases to the predetermined value or higher (namely, $430 \leqq Ne$), the engine shall be determined to have departed from the start-up mode.

The other operation mode (subsequent to a departure from the start-up operation mode) can be divided into a situation where the engine speed Ne is lower than a first reference speed (in this embodiment, 1,000 rpm) ($Ne<1{,}000$) and another situation where the engine speed Ne has reached the first reference speed (1,000 rpm) ($1{,}000 \leqq Ne$).

When the engine speed Ne has reached the first reference speed (1,000 rpm) ($1{,}000 \leqq Ne$), the timer 35 is caused to start counting at the time point of the arrival at the rotational speed. If the engine speed Ne remains at the same level as the first reference speed, the timer 35 is allowed to continue the counting until the count of the timer 35 reaches a predetermined value (until a predetermined time as the predetermined period elapses).

Accordingly, the situation where the engine speed Ne has reached the first reference speed ($1{,}000 \leqq Ne$) can be divided further into a situation which lasts until the count of the timer 35 reaches the predetermined value (namely, during timer counting) and another situation which begins after the count of the timer 35 has reached the predetermined value (in other words, after the end of timer counting).

After the count of the timer 35 has reached the predetermined value (after the end of timer counting), the solenoid-operated directional control valve 14 is closed, the injector gain is set on the high pressure side, and the injector dead time is also set on the high pressure side. Incidentally, these settings are also performed by the drive duration setting unit 34 which will be described subsequently herein.

On the other hand, the situation in which the timer is still counting subsequent to the arrival of the engine speed Ne at the first reference speed can be divided further into a situation where the engine speed Ne has not reached a second reference speed (in this embodiment, 2,000 rpm) ($1{,}000 \leqq Ne \leqq 2{,}000$) and another situation where the engine speed Ne has reached the second reference speed ($2{,}000 \leqq Ne$).

In the situation where the engine speed Ne has not reached the second reference speed ($1{,}000 \leqq Ne \leqq 2{,}000$), a state similar to that at the time of the start-up operation mode, namely, a state in which the solenoid-operated directional control valve 14 is opened and the injector gain is set on the low pressure side continues, and the injector dead time also remains on the low pressure side.

In the situation where the engine speed Ne has reached the second reference speed ($2{,}000 \leqq Ne$), on the other hand, the solenoid-operated directional control valve 14 is closed, the injector gain is set on the high pressure side and the injector dead time is also set on the high pressure side, even if the predetermined time has not elapsed (in other words, even if the timer is still counting). Incidentally, these settings are also performed by the drive duration setting unit 34 which will be described subsequently herein.

During stopping of the engine (while the engine remains stopped), the solenoid-operated directional control valve 14 is closed.

By the way, it is to secure a flow passage for the fuel, which has been delivered from the low-pressure fuel pump 4, on the downstream side of the injectors 1 upon start-up to achieve a stable flow of the fuel at a low pressure and further to permit a discharge of vapor (vapor bubbles), which are contained in the fuel line 3 in the vicinity of the injectors 1, by the flow of the fuel in an initial stage of a start-up of the engine that the specific operation state is set as described above to open the solenoid-operated directional control valve 14 and also to set the injector gain and the injector dead time on the low pressure sides.

After a start-up, it is desired to raise the fuel pressure as promptly as possible and to perform the fuel injection at a high pressure. The high-pressure fuel pump 5 is however driven by the engine so that, if the engine speed does not become high, the delivery pressure of the high-pressure fuel pump 5 does not increase and the fuel injection cannot be performed at a high pressure. In contrast, the high-pressure fuel pump 5 may become an obstacle against a fuel delivery from the low-pressure fuel pump 4. To cope with this problem, the first bypass passage 11 and the check valve 12 are arranged as described above.

Unless the delivery pressure of the high-pressure fuel pump 5 increases as mentioned above, the high-pressure control valve 10 arranged downstream the injectors 1 interferes with the flow of the fuel. It is therefore possible neither to supply the low-pressure fuel in a sufficient quantity nor to discharge vapor which is contained in the vicinity of the injectors 1. Accordingly, the solenoid-operated directional control valve 14 is turned on to open the second bypass passage 13 so that a fuel passage can be secured on the downstream side of the injectors 1 to achieve a sufficient supply quantity of fuel at a low pressure and also to permit a discharge of vapor contained in the vicinity of the injectors 1.

To retain a constant fuel pressure (the low fuel pressure regulated by the low-pressure regulator 9) even when the second bypass passage 13 is opened, the fuel pressure holding device 15 is arranged.

When the delivery pressure of the high-pressure fuel pump 5 has become higher, it is desired to promptly shift to a fuel injection state at a high pressure as intended. However, this increase in the delivery pressure of the high-pressure fuel pump 5 corresponds to an increase in the engine speed and an extension the elapsed time.

In other words, when the engine speed increases sufficiently, the delivery pressure of the high-pressure fuel pump 5 also increases obviously. Further, when the engine speed increases to a certain extent although it is still not sufficient, the delivery pressure of the high-pressure fuel pump 5 increases corresponding to a time during which the above state is retained.

As has been described above, the second reference speed has therefore been set as a reference for a sufficient increase in the engine speed, the first reference speed has been set as a reference for an increase in the engine speed although the increase is not sufficient, and a reference time (preset time) which is expected to achieve an increase in the delivery pressure of the high-pressure fuel pump 5 in the above state (in the state that the first reference speed has been reached) is determined.

The controller 30 in the system of this embodiment is also provided with a function (fault detection unit) 31 of determining a fault in the solenoid-operated directional control valve 14 and a function (fuel injection valve drive duration setting unit) 34 of setting a drive duration of the injectors 1. This drive duration setting unit 34 is provided with a function (fuel injection valve drive duration changing unit) 32 of changing the drive duration of the injectors 1 on the basis of the results of a detection by the fault detection unit 31.

The fault detection unit 31 detects a fault of the solenoid-operated directional control valve 14 by determining whether or not the solenoid-operated directional control valve 14 is left closed at the time of a start-up of the engine. Specifically, the fault detection unit detects a fault of the solenoid-operated directional control valve 14 by determining whether the switch 17 attached to the solenoid-operated directional control valve 14 is ON or OFF at the time of a start-up of the engine.

The fuel injection valve drive duration setting unit (drive duration setting unit) 34 sets a drive duration of the injectors 1 in accordance with an operation state of the engine. In this embodiment, the injector gain on the high pressure side (first drive duration) is set corresponding to a fuel pressure (first regulated pressure) regulated by the high-pressure control valve 10, while the injector gain on the low pressure side (second drive duration) is set corresponding to a fuel pressure (second regulated pressure) regulated by the low-pressure control valve 9.

An injector dead time is also set at the drive duration setting unit 34. The injector gain on the low pressure side is set for a longer time than the injector gain on the high pressure side.

The fuel injection valve drive duration changing unit (drive duration changing unit) 32, which is arranged in the drive duration setting unit 34, is provided with a function (fuel pressure estimation unit) 32A of estimating a fuel pressure on the basis of an engine speed (rotational speed of the engine), which has been detected by the engine speed sensor (speed sensor) 33, when the solenoid-operated directional control valve 14 is detected by the fault detection unit 31 to have been left closed. The drive duration changing unit 32 changes a drive duration of the fuel injection valves, namely, an injector gain in accordance with a fuel pressure estimated by the fuel pressure estimation unit 32A.

Described specifically, a map indicative of a relationship between engine speed Ne and fuel pressure ρ is prepared in advance. When the solenoid-operated directional control valve 14 is detected to have been left closed, the fuel pressure ρ is calculated with reference to the map. A high-pressure time injector gain is then corrected by the thus-calculated fuel pressure ρ to calculate a fuel injection pulse width.

As the map indicative of the relationship between engine speed Ne and fuel pressure ρ, one having such a relationship as shown in TABLE 1 is used.

TABLE 1

| Ne (rpm) | 100 | 200 | 300 | 400 |
|---|---|---|---|---|
| Fuel pressure ρ (MPa) | 0.5 | 1.0 | 1.5 | 2.0 |

As is shown in TABLE 1, the fuel pressure ρ is considered to be 0.5 MPa when the engine speed Ne is 100 rpm, the fuel pressure ρ is considered to be 1.0 MPa when the engine speed Ne is 200 rpm, the fuel pressure ρ is considered to be 1.5 MPa when the engine speed Ne is 300 rpm, and the fuel pressure ρ is considered to be 2.0 MPa when the engine speed Ne is 400 rpm.

For the correction of each injector gain, the following formula (1) is used:

Injector gain=High-pressure time injector gain×(ρ//5)½ (high-pressure time: 5 MPa) (1)

Namely, the injector gain is corrected by introducing into the formula (1) a fuel pressure ρ calculated with reference to the map.

Because the fuel feeding system for the internal combustion engine as the first embodiment of the present invention is constructed as described above, it operates, for example, as shown in the flow chart of FIG. 2.

Described specifically, as is illustrated in FIG. 2, it is first determined whether or not the engine is in a stalled state (step S201). If not in a stopped state, it is then determined whether or not the ignition key switch 16 has been placed at a starter-on position (step S202). If the ignition key switch 16 is in the starter-on position, the engine is determined to be in the start-up operation mode, and the timer 35 is reset to 0 (step S203).

At this time, the low-pressure fuel pump 4 and the high-pressure fuel pump 5 are actuated concurrently with a start-up (namely, cranking) of the engine and at the same time, the controller 30 energizes the solenoid-operated directional control valve 14 to open the second bypass passage 13 (step S204).

It is next determined whether or not the solenoid-operated directional control valve 14 has developed any fault due to a disconnection or the like, in other words, whether or not the second bypass passage 13 has been left closed (step S205).

If the second bypass passage 13 has been left closed, an injector gain is changed in accordance with an engine speed (step S206 and step S207). Namely, a fuel pressure ρ which is estimated from the map of the engine speed Ne and the fuel pressure ρ is calculated (step S206), and the injector gain is changed by correcting it with this estimated fuel pressure ρ (step S207).

This makes it possible to inject an adequate quantity of fuel from each injector even if the solenoid-operated directional control valve 14 develops a fault. A supply of air and fuel at an appropriate air/fuel ratio is thus achieved and, although a discharge of vapor is not performed promptly, combustion of a generally acceptable stability level can be performed. By subsequent injections of fuel at a high fuel pressure, the engine can be brought into a normal operation.

As the solenoid-operated directional control valve 14 is considered to have developed a fault by a disconnection or the like, a warning is given to an operator, for example, by sounding an alarm or turning on a warning lamp (step S208).

If the solenoid-operated directional control valve 14 is normally operating and the second bypass passage 13 is open, the routine advances from steps S204,S205 to steps S209,S210, and the fuel injection valves 1 are driven under control in the specific operation mode. Namely, an injector gain for a low pressure mode is selected (step S209) and an injector dead time for the low pressure mode is selected (step S210).

When the engine speed then exceeds the predetermined value (for example, 430 rpm), the start-up mode is determined to have ended, and the routine advances from step S202 to step S211, where it is determined whether or not the engine speed has exceeded the first reference speed (for example, 1,000 rpm). If the engine speed is higher than the first reference speed (for example, 1,000 rpm), the timer 35 is caused to start counting (step S212).

Then, a determination of step S213 is executed, that is, it is determined whether or not the count of the timer 35 has reached the predetermined value. If the count of the timer 35 has not reached the predetermined value, the routine advances to step S214 to determine whether or not the engine speed has exceeded the second reference speed (for example, 2,000 rpm).

If the engine speed has not exceeded the second reference speed (for example, 2,000 rpm), the operations of steps S204 to S210 are continued until the count of the timer 35 reaches the predetermined value (in other words, until the predetermined time is elapsed).

In this state, the fuel which has been delivered from the low-pressure fuel pump (feed pump) 4 and then regulated to a predetermined low-pressure value by the downstream low-pressure control valve (low-pressure regulator) 9 is fed to the fuel injection valves (injectors) 1, and any remaining portion of the fuel is returned to the fuel tank. The low-pressure fuel pump 4 is promptly brought to a delivery pressure level of a predetermined pressure (several atmospheres) subsequent to a start-up, but shortly after the start-up of the engine, the speed of the engine does not increase. The high-pressure fuel pump 5 therefore does not produce a sufficient delivery pressure.

Accordingly, shortly after the start-up of the engine, the high-pressure fuel pump 5 rather acts as a resistance to the passage of a flow of the fuel through the fuel line 3 under the delivery pressure from the low-pressure fuel pump 4. According to the system of this embodiment, the fuel is however supplied toward the fuel injection valves 1 through the first bypass passage 11 arranged in parallel with the high-pressure fuel pump 5. From the fuel injection valves 1, fuel injection can therefore be performed at a fuel pressure similar to a pressure regulated by the low-pressure control valve 9.

Shortly after a start-up of an engine, a quantity of fuel required for combustion is generally small so that a pulse width for fuel injection is short. Further, a pulse timing for the fuel injection is sufficient if it takes place only in an intake stroke as in the conventional multipoint injection (MPI). As the injector gain and injector dead time for the low pressure mode are selected accordingly and the fuel injection is then performed, the engine speed can be smoothly increased even at a fuel pressure similar to the level of the pressure regulated by the low-pressure control valve 9 insofar as the fuel pressure is stable.

As has been mentioned above, even when the solenoid-operated directional control valve 14 is out of order, it is of course possible to assure combustion of a generally acceptable stability level and to increase the speed of the engine.

Accordingly, as the speed of the engine increases, the delivery rate of the high-pressure fuel pump 5 increases and the delivery pressure of the high-pressure fuel pump 5 also increases smoothly. When the engine speed has exceeded the second reference speed (2,000 rpm) or when a predetermined time (predetermined period) has elapsed at a speed level above the first reference speed (1000 rpm) although the engine speed has not exceeded the second reference speed (2,000 rpm), the routine advances from step S213 or step S214 to step S215, where the controller 30 allows the second bypass passage 13 to remain closed without performing energization of the solenoid-operated directional control valve 14, and drives the fuel injection valves 1 under control in the normal operation mode (namely, the high pressure mode). Namely, the injector gain for the high pressure mode is selected (step S216) and the injector dead time for the high pressure mode is selected (step S217). The timer 35 is then reset to 0 (step S218). Thereafter, the operations of steps S215–S218 are continued for as long as the engine does not stop.

As a result, the fuel which has been delivered from the low-pressure fuel pump (feed pump) 4, pressurized to a high pressure through the high-pressure fuel pump 12 and then regulated to a predetermined high-pressure value by the high-pressure control valve (high-pressure regulator) 10 is fed to the fuel injection valves (injectors) 1, and any remaining portion of the fuel is returned to the fuel tank.

Accordingly, the delivery pressure of the high-pressure fuel pump 5 progressively increases the fuel pressure on the downstream side of the high-pressure fuel pump 5 without being lost, whereby the fuel pressure is raised to a level higher than the pressure regulated by the high-pressure control valve 10. Further, owing to the selection of the injector gain for the high pressure mode and the injector dead time for the high pressure mode, fuel injection can be performed adequately.

There is accordingly the advantage that, even when the solenoid-operated directional control valve 14 has developed a fault by a disconnection or the like, a suitable drive duration can be set for the injectors 1 in accordance with an operation state of the engine, namely, a fuel pressure.

Even when the solenoid-operated directional control valve 14 has developed a fault especially at the time of a start-up of the engine, an appropriate injector gain can be set in accordance with an operation state of the engine, namely, a fuel pressure. This makes it possible to prevent the engine from being deteriorated in startability and further from becoming no longer feasible to be started up, leading to the advantage that startability of a minimum level can be assured.

A description will next be made about a modification of the first embodiment.

This system has substantially the same constitution as the above-described system of the first embodiment but is different in that, to calculate an injector gain from an engine speed Ne, it is equipped with a map indicative of a relationship between engine speed Ne and injector gain.

Further, operation of fuel supply control by this system is different in that the two steps (step S206 and step S207) for calculating an injector gain from an engine speed Ne in the flow chart (see FIG. 2) illustrating the operation of fuel supply control by the above-described system of the first embodiment are changed to a single step (in which an injector gain is calculated directly from an engine speed Ne with reference to a map indicative of a relationship between engine speed Ne and injector gain).

The map indicative of the relationship between engine speed Ne and injector gain is prepared as shown in TABLE 2.

TABLE 2

| Ne (rpm) | 100 | 200 | 300 | 400 |
|---|---|---|---|---|
| Injector gain (cc/ms) | 2.5 | 3.0 | 4.0 | 5.0 |

As is shown in TABLE 2, the injector gain is considered to be 2.5 cc/ms when the engine speed Ne is 100 rpm, the injector gain is considered to be 3.0 cc/ms when the engine speed Ne is 200 rpm, the injector gain is considered to be 4.0 cc/ms when the engine speed Ne is 300 rpm, and the injector gain is considered to be 5.0 cc/ms when the engine speed Ne is 400 rpm.

Even when the solenoid-operated directional control valve 14 has developed a fault due to a disconnection or the like, it is therefore possible to set an injector gain (drive duration of the fuel injection valves) in accordance with a fuel pressure higher than a controlled pressure by the low-pressure control valve 9, leading to an advantage that combustion in the engine can be performed adequately. Further, as an injector gain can be calculated directly from an engine speed Ne, there is another advantage that a control logic can be simplified.

In the fuel feeding system of this embodiment for the internal combustion engine, the drive duration of the injectors 1 is changed based on the results of a detection by the engine speed sensor 33 as a speed sensor. The speed sensor is however not limited to this and may be constituted, for example, as one adapted to detect a rotational speed of the high-pressure fuel pump or a rotary member which rotates in synchronization with the high-pressure fuel pump.

Figure 3:
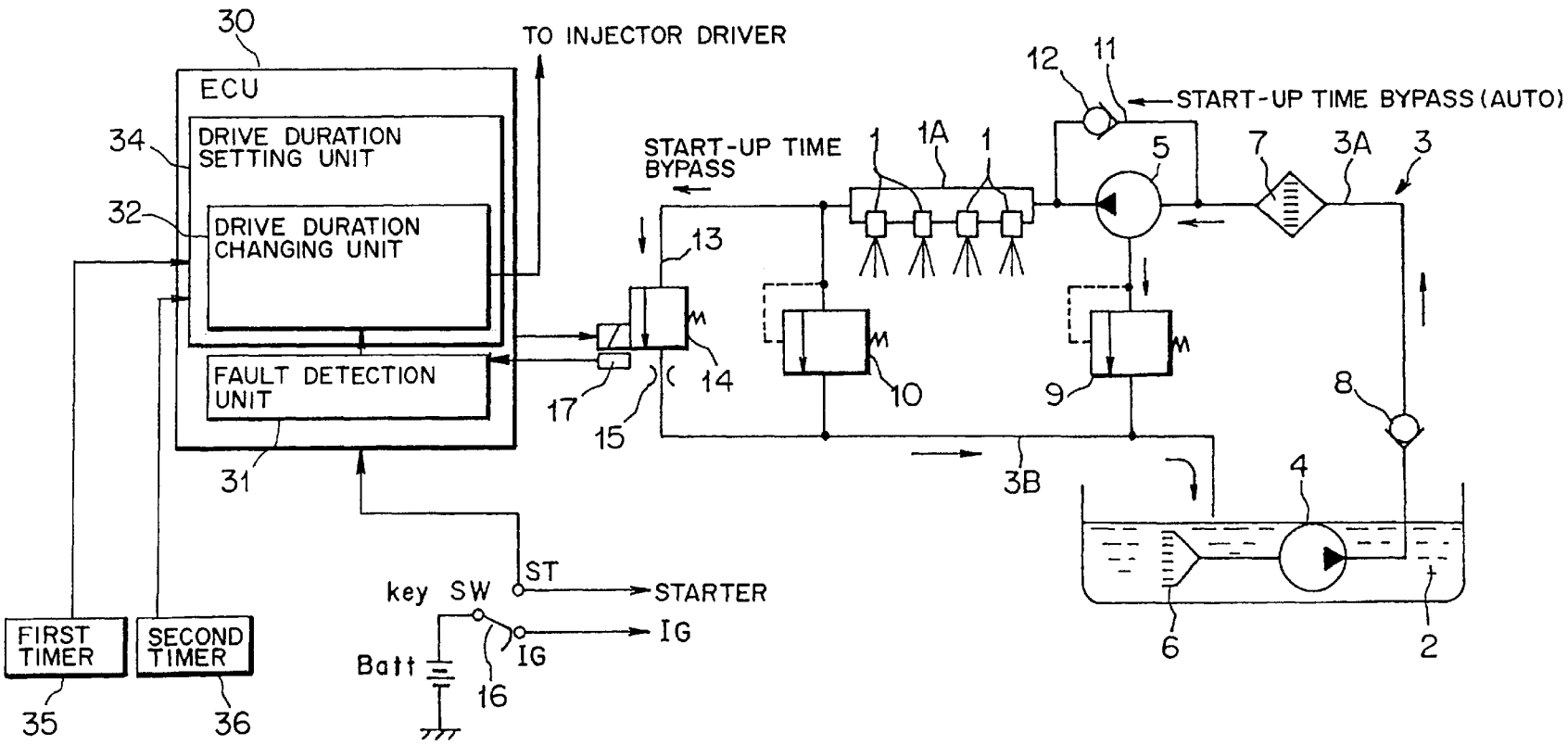
FIG. 3 is a schematic block diagram showing a fuel feeding system according to a second embodiment of the present invention for an internal combustion engine.
Figure 4:
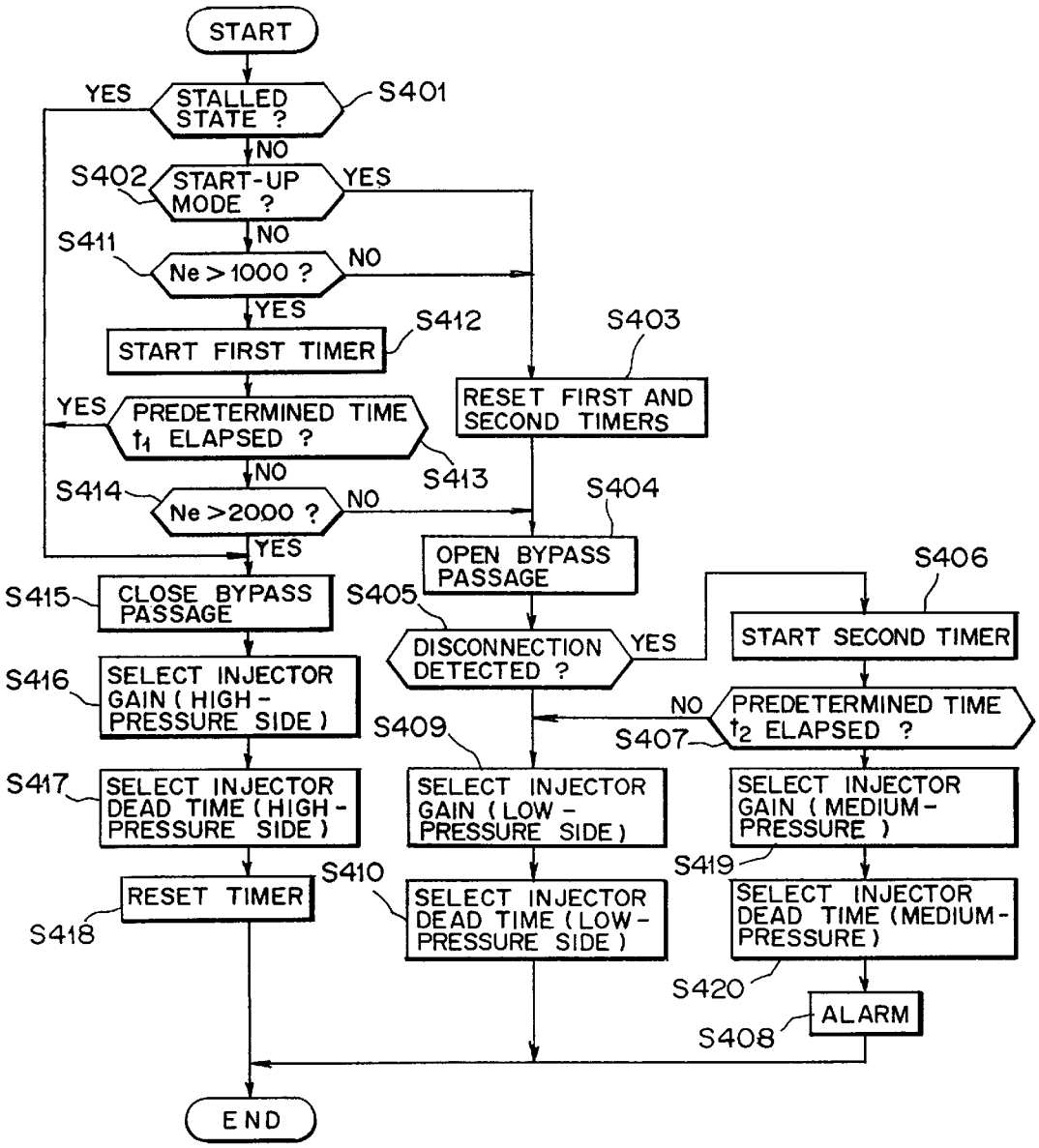
FIG. 4 is a flow chart illustrating operation of the fuel feeding system according to the second embodiment of the present invention for the internal combustion engine.

Next, a description will be made about the fuel feeding system according to the second embodiment of the present invention for the internal combustion engine. FIG. 3 is its schematic diagram, and FIG. 4 is its flow chart illustrating its operation.

The fuel feeding system of this embodiment for the internal combustion engine is different from the above-described system of the first embodiment in the drive duration changing unit arranged in the drive duration setting unit of the controller. Namely, the drive duration changing unit arranged in the drive duration setting unit changes a drive duration of the fuel injection valves in accordance with a time elapsed subsequent to detection of a disconnection instead of changing the drive duration of the fuel injection valves in accordance with an engine speed Ne.

As is illustrated in FIG. 3, this system is provided with a second timer 36 in addition to the first timer 35. The second timer 36 counts a time elapsed after detection of a disconnection by a fault detection unit 31, and starts counting when an solenoid-operated directional control valve 14 is detected by the fault detection unit 31 to have been left closed (when a disconnection is detected).

Incidentally, the first timer 35 is similar to the timer 35 employed in the above-described first embodiment, and counts a time elapsed after the engine speed Ne has reached the first reference speed. A predetermined value $t_1$ (namely, a predetermined time), which is used for the determination of a count of the first timer 35, is the same as the predetermined value (namely, the predetermined time) employed for the determination of a count of the timer 35 in the above-described first embodiment.

Like the above-described first embodiment, a drive duration setting unit 34 performs setting of an injector gain (second drive duration) on the low pressure side and an injector gain (first drive duration) on the high pressure side. In this embodiment, setting of an injector gain for an intermediate pressure (third drive duration) is also performed. In addition, setting of an injector dead time for the intermediate pressure is also performed.

The intermediate-pressure injector gain set by the drive duration setting unit 34 is set beforehand as a fixed value, for example, of a magnitude falling between the injector gain on the high pressure side and the injector gain on the low pressure side [namely, of a magnitude corresponding to a fuel pressure (e.g., 2 to 3 MPa) falling between a fuel pressure (for example, 0.33 MPa) in the low pressure mode and a fuel pressure (for example, 5 MPa) in the high pressure mode].

Further, this intermediate-pressure injector gain is selected by a drive duration changing unit 32 arranged in the drive duration setting unit 34 when the count of the second timer 36 has reached a predetermined value $t_2$. The predetermined value $t_2$ may be set in accordance with the engine coolant temperature or the like, although it is set as a fixed value in this embodiment.

It is therefore designed that a count of the second timer 36 be inputted to the drive duration changing unit 32, which is arranged in the drive duration setting unit 34, to determine whether or not this count has reached the predetermined value $t_2$ (in other words, whether or not a predetermined time has elapsed).

If the count of the second timer 36 has not reached the predetermined time $t_2$, the drive duration changing unit 32 is designed to select the injector gain on the low pressure side.

As the fuel feeding system of this embodiment is constituted as mentioned above, it operates as illustrated in the flow chart of FIG. 4.

Namely, as is illustrated in FIG. 4, it is first determined whether the engine is in a stalled state (step S401). If not in a stopped state, it is then determined whether or not the ignition key switch 16 has been placed at the starter-on position (step S402). If the ignition key switch 16 is in the starter-on position, the engine is determined to be in the start-up operation mode, and the routine advances to step S403, where the first timer 35 and the second timer 36 are reset to 0. Incidentally, when the first timer 35 and the second timer 36 have already been reset, this step is merely to confirm that these timers have been reset.

At this time, the low-pressure fuel pump 4 and the high-pressure fuel pump 5 are actuated concurrently with a start-up (namely, cranking) of the engine and at the same time, the controller 30 energizes the solenoid-operated directional control valve 14 to open the second bypass passage 13 (step S404).

It is next determined whether or not the solenoid-operated directional control valve 14 has developed any fault due to a disconnection or the like, in other words, whether or not the second bypass passage 13 has been left closed (step S405).

If the second bypass passage 13 has been left closed, the second timer 36 starts counting (step S406). The routine then advances to step S407, where it is determined whether or not the count of the second timer 36 has reached the predetermined value $t_2$ (whether or not the predetermined time has elapsed since the detection of a disconnection).

If the count of the second timer 36 is not found to have reached the predetermined value $t_2$ as a result of the above determination, it is determined that the fuel pressure is still low. The routine hence advances to step S409 and S410 to be described subsequently herein, where the injector gain on the low pressure side and the injector dead time on the low pressure side are selected.

If the count of the second timer 36 is found to have reached the predetermined value $t_2$, on the other hand, the intermediate-pressure injector gain set in accordance with the characteristics of the engine and those of the fuel system is selected (step S419), and the intermediate injector dead time is selected (step S420).

As the solenoid-operated directional control valve 14 is considered to have developed a fault by a disconnection or the like, a warning is given to an operator, for example, by sounding an alarm or turning on a warning lamp (step S408).

If the solenoid-operated directional control valve 14 is normally operating and the second bypass passage 13 is open, the routine advances from steps S404,S405 to steps S409,S410, and the fuel injection valves 1 are driven under control in the specific operation mode. Namely, the injector gain on the low pressure side is selected (step S409) and the injector dead time on the low pressure side is selected (step S410).

When the engine speed then exceeds the predetermined value (for example, 430 rpm), the start-up mode is determined to have ended, and the routine advances from step S402 to step S411, where it is determined whether or not the engine speed has exceeded the first reference speed (for example, 1,000 rpm).

If the engine speed is not found to have exceeded the first reference speed (for example, 1,000 rpm) as a result of the above determination, the above-described processings of step S403 to step S410, step S419 and step 420 are repeated.

If the engine speed is found to have exceeded the first reference speed (1000 rpm), on the other hand, the first timer 35 starts counting (step S412).

Then, a determination of step S413 is executed, that is, it is determined whether or not the count of the first timer 35 has reached the predetermined value$t_1$ [whether or not the predetermined time (predetermined period) has elapsed]. If the count of the first timer 35 is not found to have reached the predetermined value $t_1$, the routine advances to step S414 to determine whether or not the engine speed has exceeded the second reference speed (for example, 2,000 rpm).

If the engine speed is not found to have exceeded the second reference speed (for example, 2,000 rpm) as a result of the above determination, the above-described processings of steps S404 to S410, step S419 and S420 are repeated until the count of the first timer 35 reaches the predetermined value $t_1$.

In this state, the fuel which has been delivered from the low-pressure fuel pump (feed pump) 4 and then regulated to a predetermined low-pressure value by the downstream low-pressure control valve (low-pressure regulator) 9 is fed to the fuel injection valves (injectors) 1, and any remaining portion of the fuel is returned to the fuel tank. The low-pressure fuel pump 4 is promptly brought to a delivery pressure level of a predetermined pressure (several atmospheres) subsequent to a start-up, but shortly after the start-up of the engine, the speed of the engine does not increase. The high-pressure fuel pump 5 therefore does not produce a sufficient delivery pressure.

Accordingly, shortly after the start-up of the engine, the high-pressure fuel pump 5 rather acts as a resistance to the passage of a flow of the fuel through the fuel line 3 under the delivery pressure from the low-pressure fuel pump 4. According to the system of this embodiment, the fuel is however supplied toward the fuel injection valves 1 through the first bypass passage 11 arranged in parallel with the high-pressure fuel pump 5. From the fuel injection valves 1, fuel injection can therefore be performed at a fuel pressure similar to a pressure regulated by the low-pressure control valve 9.

Shortly after a start-up of an engine, a quantity of fuel required for combustion is generally small so that a pulse width for fuel injection is short. Further, a pulse timing for the fuel injection is sufficient if it takes place only in an intake stroke as in the conventional multipoint injection (MPI). As the injector gain and injector dead time for the low pressure mode are selected accordingly and the fuel injection is then performed, the engine speed can be smoothly increased even at a fuel pressure similar to the level of the pressure regulated by the low-pressure control valve 9 insofar as the fuel pressure is stable.

As has been mentioned above, even when the solenoid-operated directional control valve 14 is out of order, it is of course possible to assure combustion of a generally acceptable stability level and to increase the speed of the engine.

Accordingly, as the speed of the engine increases, the delivery rate of the high-pressure fuel pump 5 increases and the delivery pressure of the high-pressure fuel pump 5 also increases smoothly. When the engine speed has exceeded the second reference speed (2000 rpm) or when a predetermined time has elapsed at a speed level above the first reference speed (1000 rpm) although the engine speed has not exceeded the second reference speed (2000 rpm), the routine advances to step S415, where the controller 30 allows the second bypass passage 13 to remain closed without performing energization of the solenoid-operated directional control valve 14, and drives the fuel injection valves 1 under control in the normal operation mode (namely, the high pressure mode).

Namely, the injector gain for the high pressure mode is selected (step S416) and the injector dead time for the high pressure mode is selected (step S417). The first timer 35 and the second timer 36 are then reset to 0 (step S418).

Thereafter, the operations of steps S415–S418 are continued for as long as the engine does not stop.

As a result, the fuel which has been delivered from the low-pressure fuel pump 4, pressurized to a high pressure through the high-pressure fuel pump 12 and then regulated to a predetermined high-pressure value by the high-pressure control valve 10 is fed to the injectors 1, and any remaining portion of the fuel is returned to the fuel tank.

Accordingly, the delivery pressure of the high-pressure fuel pump 5 progressively increases the fuel pressure on the downstream side of the high-pressure fuel pump 5 without being lost, whereby the fuel pressure is raised to a level higher than the pressure regulated by the high-pressure control valve 10. Further, owing to the selection of the injector gain on the high pressure side and the injector dead time on the high pressure side, fuel injection can be performed adequately.

There are hence advantages that, while permitting simplification of the control system and its logic, the drive duration of the injectors 1 can be brought into substantial conformity with a fuel pressure to assure good combustion in the engine even when the solenoid-operated directional control valve 14 develops a fault due to a disconnection or the like.

As the intermediate-pressure injector gain is set as a fixed value in the fuel feeding system of this embodiment for the internal combustion engine, the relationship between fuel pressure and injector gain is reduced compared with that in the first embodiment. The relationship between fuel pressure and injector gain can however be improved, provided that plural intermediate-pressure injector gains are set corresponding to fuel pressures and the plural intermediate-pressure injector gains are selected stepwise one by one toward the high pressure side in accordance with the time elapsed after the detection of a fault by the fault detection unit 31.

Even when the fuel pressure control valve 14 develops a fault and the solenoid-operated increases despite the engine is in the low pressure mode, it is therefore possible to make the injector gain more accurately correspond to the fuel pressure. An adequate quantity of fuel can hence be injected from each injector, thereby achieving a supply of air and fuel at a suitable air/fuel ratio.

Next, a description will be made about the third embodiment of the present invention.

Compared with the above-described fuel feeding systems of the first and second embodiments for the internal combustion engines, the fuel feeding system of this embodiment for the internal combustion engine is different in the determination of the pressure of fuel to be injected from the injectors 1 (namely, the fuel pressure in the fuel line on a downstream side of a high-pressure fuel pump). Namely, the fuel pressure is determined based on the state of actuation of the solenoid-operated control valve in each of the above-described first and second embodiments. Instead of this, a fuel pressure sensor which constitutes a fuel pressure determination device is additionally arranged in this embodiment, whereby a fuel pressure is determined based on detected information from the fuel pressure sensor.

In this embodiment, the fuel pressure sensor directly detects the pressure of fuel to be injected from the injectors 1 (namely, the fuel pressure in the fuel line on the downstream side of the high-pressure fuel pump).

Although not shown in the drawings, ECU in the system of this embodiment is provided with a fuel pressure determination unit, which determines the fuel pressure on the basis of information directly detected by the fuel pressure sensor. Incidentally, the fuel pressure determination device is constituted with the fuel pressure determination unit and the fuel pressure sensor of ECU incorporated therein.

Corresponding to the fuel pressure determined at the fuel pressure determination unit of ECU on the basis of the detected information from the fuel pressure sensor, an injector drive duration is set by a drive duration setting unit.

In this embodiment, the drive duration setting unit is constituted with a drive duration changing unit incorporated therein. By this drive duration changing unit, the injector drive duration can be changed based on detection results of a revolution speed detection unit, which will be described subsequently herein, when the fuel pressure sensor which constitutes the fuel pressure determination device develops a default due to a disconnection or the like.

For the above purpose, ECU of this system is provided with a fault detection unit. By this fault detection unit, a fault, such as that caused by a disconnection, in the fuel pressure sensor which constitutes the fuel pressure determination device is detected.

It is also designed that the drive duration changing unit be fed with detection information from the revolution speed detection unit. This revolution speed detection unit is, for example, an engine speed sensor which detects a revolution speed of a rotary member rotating in synchronization with the high-pressure fuel pump.

Further, the drive duration changing unit is designed to change an injector drive duration by a fuel pressure preset beforehand in accordance with a revolution speed detected by the engine speed sensor as the revolution speed detection unit.

As the fuel feeding system of this embodiment for the internal combustion engine is constituted as described above, there is an advantage that, even when the fuel pressure sensor which constitutes the fuel pressure determination device develops a fault due to a disconnection or the like, a fuel pressure is set in accordance with a state of operation of the high-pressure fuel pump, thereby making it possible to set an adequate injector drive duration and hence to perform good combustion in the engine.

Further, the fuel pressure is directly detected by the fuel pressure sensor. There is accordingly an advantage that, without changing the fuel pressure, an appropriate injector drive duration can be set in accordance with the fuel pressure and good combustion can be performed in the engine.

In this embodiment, the revolution speed detection unit is in the form of the engine speed sensor which detects a revolution speed of the rotary member rotating in synchronization with the high-pressure fuel pump. The revolution speed detection unit is however not limited to such a sensor, and can be one for directly detecting the revolution speed of the high-pressure fuel pump.

Further, the fuel pressure determination device in this embodiment is designed to determine a fuel pressure on the basis of information directly detected by the fuel pressure sensor. The fuel pressure determination device is however not limited to such a design. For example, it may be designed to indirectly determine a solenoid-operated on the basis of a state of actuation of the fuel pressure control valve which can be changed in plural stages. In this case, the state of actuation of the solenoid-operated control valve can be indicated as a value substantially correlated to a fuel pressure in the fuel line on the downstream side of the high-pressure fuel pump.

Indirect determination of a fuel pressure on the basis of a state of actuation of the solenoid-operated control valve as described above makes it possible to select a suitable fuel pressure in accordance with a state of operation, leading to an advantage that good combustion can be performed in the engine.

When a fuel pressure sensor is used as in this embodiment, a fuel feeding system for an internal combustion engine is not limited to one having such a fuel line arrangement as shown in the above-described first or second embodiment (see FIG. 1 or FIG. 3). It is possible to use, for example, a fuel line arrangement which is not provided with a high-pressure regulator, a low-pressure regulator and the like and can gradually change the fuel pressure.

Further, it may also be contemplated to perform control for achieving a desired air/fuel ratio by designing to perform control on the state of air supply to the engine in place of or in addition to control on the state of fuel supply to the engine led by control of fuel injection.

CAPABILITY OF EXPLOITATION IN INDUSTRY

Adoption of the present invention in a fuel feeding system for an internal combustion engine, which can perform fuel injection at a relatively high fuel pressure and is equipped with a fuel pressure determination device (for example, a solenoid-operated control valve, a fuel pressure sensor or the like), makes it possible to perform good combustion in the engine even when the fuel pressure determination device develops a fault due to a disconnection or the like. The start-up performance of the engine can therefore be improved significantly.

I claim:

1. A fuel feeding system for an internal combustion engine, comprising:

a low-pressure fuel pump (4) arranged between a fuel injection valve (1) disposed in said internal combustion engine and a fuel tank (2);

a fuel line (3) constituted as a recirculating circuit which extends from said fuel tank (2) to said fuel injection valve (1) and further returns from said fuel injection valve (1) to said fuel tank (2);

a high-pressure fuel pump (5) arranged in said fuel line (3) between said low-pressure fuel pump (4) and said fuel injection valve (1) and driven by said internal combustion engine;

a high-pressure control unit (10) arranged in said fuel line on a downstream side of said high-pressure fuel pump (5) for controlling a pressure of fuel delivered from said high-pressure fuel pump (5);

a fuel pressure control valve (14) arranged in a bypass passage (13), which extends from an upstream side to a downstream side of said high-pressure control unit (10), for opening or closing said bypass passage (13) in accordance with a state of operation of said internal combustion engine;

a low-pressure control unit (9) for controlling, upon opening said bypass passage (13) by said fuel pressure control valve (14), a fuel pressure in said fuel line on an upstream side of said bypass passage (13) to a pressure lower than a pressure controlled by said high-pressure control unit (10);

a fault detection unit (31) for detecting a fault in said fuel pressure control valve (14) and a resulting restriction of an opening of said bypass passage (13); and a drive duration changing unit (32) for changing, upon detection of a fault by said fault detection unit (31), a drive duration of said fuel injection valve (1) in accordance with a predetermined fuel pressure higher than a pressure controlled by said low-pressure control unit (9).

2. The fuel feeding system of claim 1, further comprising:

a revolution speed sensor (33) for detecting a revolution speed of said high-pressure fuel pump or of a rotary member rotating in synchronization with said high-pressure fuel pump, whereby said predetermined fuel pressure is estimated from said revolution speed detected by said revolution speed sensor (33).

3. The fuel feeding system of claim 2, wherein said drive duration changing unit (32) is provided with a fuel pressure estimation unit (32A) for estimating a fuel pressure on a basis of a revolution speed detected by said revolution speed sensor (33), and changes a drive duration of said fuel injection valve (1) in accordance with said fuel pressure estimated by said fuel pressure estimation unit (32A).

4. The fuel feeding system of claim 2, wherein said drive duration changing unit (32) changes a drive duration of said fuel injection valve (1) on a basis of a revolution speed detected by said revolution speed sensor (33) upon detection of a fault by said fault detection unit (31) while using a revolution speed-fuel injection valve drive duration map set beforehand on a basis of a correlation between a revolution speed and a fuel pressure.

5. The fuel feeding system of claim 1, wherein said fuel pressure control valve (14) is opened for a predetermined period at a time of a start-up of said internal combustion engine.

6. The fuel feeding system of claim 5, wherein a drive duration of said fuel injection valve (1) is changed by said drive duration changing unit (32) for at least said predetermined period.

7. A fuel feeding system for an internal combustion engine, comprising:

a low-pressure fuel pump arranged between a fuel injection valve (1) disposed in said internal combustion engine and a fuel tank (2);

a fuel line (3) constituted as a recirculating circuit which extends from said fuel tank (2) to said fuel injection valve (1) and further returns from said fuel injection valve (1) to said fuel tank (2);

a high-pressure fuel pump (5) arranged in said fuel line (3) between said low-pressure fuel pump (4) and said fuel injection valve (1) and driven by said internal combustion engine;

a high-pressure control unit (10) arranged in said fuel line on a downstream side of said high-pressure fuel pump (5) for controlling to a first controlled pressure a pressure of fuel delivered from said high-pressure fuel pump (5);

a fuel pressure control valve (14) arranged in a bypass passage (13), which extends from an upstream side to a downstream side of said high-pressure control unit (10), for opening or closing said bypass passage (13) in accordance with a state of operation of said internal combustion engine;

a low-pressure control unit (9) for controlling, upon opening said bypass passage (13) by said fuel pressure control valve (14), a fuel pressure in said fuel line on an upstream side of said bypass passage (13) to a second controlled pressure lower than said first controlled pressure by said high-pressure control unit (10);

a drive duration setting unit (34) for setting a first drive duration as a drive duration of said fuel injection valve (1) corresponding to said first controlled pressure and a second drive duration as a drive duration of said fuel injection valve (1) corresponding to said second controlled pressure, said second drive duration being longer than said first drive duration;

a fault detection unit (31) for detecting a fault in said fuel pressure control valve (14) and a resulting restriction of an opening of said bypass passage (13); and a drive duration changing unit (32) for changing, upon detection of a fault by said fault detection unit (31), a drive duration of said fuel injection valve (1) to a third drive duration which falls between said first drive duration and said second drive duration.

8. The fuel feeding system of claim 7, wherein said drive duration changing unit (32) changes a drive duration of said fuel injection valve (1) to said third drive duration upon an elapse of a predetermined time after detection of a fault by said fault detection unit (31).

9. A fuel feeding system for an internal combustion engine, comprising:

a low-pressure fuel pump (4) arranged between a fuel injection valve (1) disposed in said internal combustion engine and a fuel tank (3);

a fuel line (3) constituted as a recirculating circuit which extends from said fuel tank (2) to said fuel injection valve (1) and further returns from said fuel injection valve (1) to said fuel tank (2);

a high-pressure fuel pump (5) arranged in said fuel line (3) between said low-pressure fuel pump (4) and said fuel injection valve (1) and driven by said internal combustion engine;

a revolution speed sensor (33) for detecting a revolution speed of said high-pressure fuel pump (5) or of a rotary member rotating in synchronization with said high-pressure fuel pump (5);

a fuel pressure determination unit for directly or indirectly determining a fuel pressure in said fuel line on a downstream side of said high-pressure fuel pump (5) in accordance with a value substantially correlated to said fuel pressure in said fuel line on said downstream side of said high-pressure fuel pump (5);

a drive duration setting unit (34) for setting a drive duration of said fuel injection valve on a basis of results of a determination by said fuel pressure determination unit;

a fault detection unit (31) for detecting a fault in at least said fuel pressure determination unit; and a drive duration changing unit (32) for changing, upon detection of a fault by said fault detection unit (31), a drive duration of said fuel injection valve (1) on a basis of results of a detection by said revolution speed sensor (33).

10. The fuel feeding system of claim 9, wherein said fuel pressure determination unit is provided with a fuel pressure control valve (14) which can change over to plural levels a fuel pressure in said fuel line on said downstream side of said high-pressure fuel pump (5).

11. The fuel feeding system of claim 9, wherein said fuel pressure determination unit is provided with a fuel pressure sensor for detecting a fuel pressure in said fuel line on said downstream side of said high-pressure fuel pump (5).

12. The fuel feeding system of claim 2, wherein said fuel pressure control valve (14) is opened for a predetermined period at a time of a start-up of said internal combustion engine.

13. The fuel feeding system of claim 12, wherein a drive duration of said fuel injection valve (1) is changed by said drive duration changing unit (32) for at least said predetermined period.

14. The fuel feeding system of claim 3, wherein said fuel pressure control valve (14) is opened for a predetermined period at a time of a start-up of said internal combustion engine.

15. The fuel feeding system of claim 14, wherein a drive duration of said fuel injection valve (1) is changed by said drive duration changing unit (32) for at least said predetermined period.

16. The fuel feeding system of claim 4, wherein said fuel pressure control valve (14) is opened for a predetermined period at a time of a start-up of said internal combustion engine.

17. The fuel feeding system of claim 14, wherein a drive duration of said fuel injection valve (1) is changed by said drive duration changing unit (32) for at least said predetermined period.

* * * * *

UNITED STATES PATENT AND TRADEMARK OFFICE
CERTIFICATE OF CORRECTION

PATENT NO : 5,918,578
DATED : July 6, 1999
INVENTOR(S) : Hideyuki ODA

It is certified that error appears in the above-identified patent and that said Letters Patent is hereby corrected as shown below:

Col. 23

Line 46, delete "(4)";

Line 47, delete "(1)";

Line 48, delete "(2)";

Line 50, delete "(3)";

Line 51, delete "(2)";

Line 52, delete "(1)";

Line 53, delete "(1)";

delete "(2)";

Line 54, delete "(5)";

delete "(3)";

UNITED STATES PATENT AND TRADEMARK OFFICE
CERTIFICATE OF CORRECTION

PATENT NO : 5,918,578
DATED : July 6, 1999
INVENTOR(S) : Hideyuki ODA

It is certified that error appears in the above-identified patent and that said Letters Patent is hereby corrected as shown below:

Col. 23 (cont'd)

Line 55, delete "(4)";

Line 56, delete "(1)";

Line 58, delete "(10)";

Line 60, delete "(5)";

Line 61, delete "(5)";

Line 62, delete "(14)";

Line 63, delete "(13)";

Line 65, delete "(10)";

delete "(13)";

Col. 24

Line 1, delete "(9)";

Line 2, delete "(13)";

Line 3, delete "(14)";

Line 4, delete "(13)";

Line 6, delete "(10)";

Line 7, delete "(31)";

Line 8, delete "(14)";

UNITED STATES PATENT AND TRADEMARK OFFICE

CERTIFICATE OF CORRECTION

PATENT NO : 5,918,578
DATED : July 6, 1999
INVENTOR(S) : Hideyuki ODA

It is certified that error appears in the above-identified patent and that said Letters Patent is hereby corrected as shown below:

Col. 24 (cont'd)

Line 9, delete "(13)";

Line 10, delete "(32)";

Line 11, delete "(31)";

Line 12, delete "(1)";

Line 15, delete "(9)";

Line 17, delete "(33)";

Line 23, delete "(33)";

Line 25, delete "(32)";

Line 26, delete "(32A)";

Line 28, delete "(33)";

Line 29, delete "(1)";

Line 30, delete "(32A)";

Line 32, delete "(32)";

Line 33, delete "(1)";

Line 34, delete "(33)";

Line 35, delete "(31)";

Line 40, delete "(14)";

UNITED STATES PATENT AND TRADEMARK OFFICE

CERTIFICATE OF CORRECTION

PATENT NO : 5,918,578
DATED : July 6, 1999
INVENTOR(S) : Hideyuki ODA

It is certified that error appears in the above-identified patent and that said Letters Patent is hereby corrected as shown below:

Col. 24 (cont'd)

Line 44, delete "(1)";

Line 45, delete "(32)";

Line 51, delete "(1)";

Line 52, delete "(2)";

Line 53, delete "(3)";

Line 54, delete "(2)";

Line 55, delete "(1)";

Line 56, delete "(1)";

delete "(2)";

Line 57, delete "(5)";

delete "(3)";

Line 58, delete "(4)";

Line 59, delete "(1)";

Line 61, delete "(10)";

Line 63, delete "(5)";

Line 65, delete "(5)";

Line 66, delete "(14)";

UNITED STATES PATENT AND TRADEMARK OFFICE
CERTIFICATE OF CORRECTION

PATENT NO : 5,918,578
DATED : July 6, 1999
INVENTOR(S) : Hideyuki ODA

It is certified that error appears in the above-identified patent and that said Letters Patent is hereby corrected as shown below:

Col. 24 (cont'd)

Line 67, delete "(13)";

Col. 25

Line 2, delete "(10)";

delete "(13)";

Line 5, delete "(9)";

Line 6, delete "(13)";

Line 7, delete "(14)";

Line 8, delete "(13)";

Line 10, delete "(10)";

Line 11, delete "(34)";

Line 13, delete "(1)";

Line 15, delete "(1)";

Line 18, delete "(31)";

Line 19, delete "(14)";

Line 20, delete "(13)";

Line 22, delete "(32)";

Line 23, delete "(31)";

UNITED STATES PATENT AND TRADEMARK OFFICE
CERTIFICATE OF CORRECTION

PATENT NO : 5,918,578
DATED : July 6, 1999
INVENTOR(S) : Hideyuki ODA

It is certified that error appears in the above-identified patent and that said Letters Patent is hereby corrected as shown below:

Col. 25 (cont'd)

Line 24, delete "(1)";

Line 28, delete "(32)";

Line 29, delete "(1)";

Line 31, delete "(31)";

Line 34, delete "(4)";

Line 35, delete "(1)";

Line 36, delete "(3)";

Line 37, delete "(3)";

Line 38, delete "(2)";

Line 39, delete "(1)";

Line 40, delete "(1)";

delete "(2)";

Line 41, delete "(5)";

delete "(3)";

Line 42, delete "(4)";

Line 43, delete "(1)";

Line 46, delete "(33)";

UNITED STATES PATENT AND TRADEMARK OFFICE

CERTIFICATE OF CORRECTION

PATENT NO : 5,918,578
DATED : July 6, 1999
INVENTOR(S) : Hideyuki ODA

It is certified that error appears in the above-identified patent and that said Letters Patent is hereby corrected as shown below:

Col. 25 (cont'd)

Line 47, delete "(5)";

Line 49, delete "(5)";

Col. 26

Line 1, delete "(5)";

Line 4, delete "(5)";

Line 5, delete "(34)";

Line 9, delete "(31)";

Line 12, delete "(32)";

Line 13, delete "(31)";

Line 14, delete "(1)";

Line 16, delete "(33)";

Line 19, delete "(14)";

Line 21, delete "(5)";

Line 25, delete "(5)";

Line 27, delete "(14)";

Line 31, delete "(1)";

Line 32, delete "(32)";

UNITED STATES PATENT AND TRADEMARK OFFICE

CERTIFICATE OF CORRECTION

PATENT NO : 5,918,578
DATED : July 6, 1999
INVENTOR(S) : Hideyuki ODA

It is certified that error appears in the above-identified patent and that said Letters Patent is hereby corrected as shown below:

Col. 26 (cont'd)

Line 35, delete "(14)";

Line 39, delete "(1)";

Line 40, delete "(32)";

Line 43, delete "(14)";

Line 47, delete "(1)";

Line 48, delete "(32)".

Signed and Sealed this

Nineteenth Day of September, 2000

*Attest:*

Q. TODD DICKINSON

*Attesting Officer*

*Director of Patents and Trademarks*